US012781731B2

(12) United States Patent
Nagura et al.

(10) Patent No.: US 12,781,731 B2
(45) Date of Patent: Nov. 3, 2026

(54) COMPRESSOR UNIT

(71) Applicant: KOBE STEEL, LTD., Hyogo (JP)

(72) Inventors: Kenji Nagura, Takasago (JP); Kenji Kubo, Takasago (JP); Katsuhiro Seyama, Takasago (JP); Satoshi Tezuka, Takasago (JP)

(73) Assignee: KOBE STEEL, LTD., Hyogo (JP)

( * ) Notice: Subject to any disclaimer, the term of this patent is extended or adjusted under 35 U.S.C. 154(b) by 0 days.

(21) Appl. No.: 19/147,077

(22) PCT Filed: Jan. 24, 2024

(86) PCT No.: PCT/JP2024/002070
§ 371 (c)(1),
(2) Date: Jul. 10, 2025

(87) PCT Pub. No.: WO2024/171743
PCT Pub. Date: Aug. 22, 2024

(65) Prior Publication Data

US 2026/0218700 A1 Jul. 30, 2026

(30) Foreign Application Priority Data

Feb. 13, 2023 (JP) ..... 2023-020152

(51) Int. Cl.
*F04B 49/22* (2006.01)
*F04B 15/08* (2006.01)
*F04B 25/00* (2006.01)

(52) U.S. Cl.
CPC ..... *F04B 49/22* (2013.01); *F04B 2015/0822* (2013.01); *F04B 25/00* (2013.01); *F04B 2205/065* (2013.01); *F04B 2205/10* (2013.01)

(58) Field of Classification Search
CPC ..... F04B 2205/10; F04B 37/10; F04B 49/22; F04B 49/007; F04B 49/022; F04B 49/08;
(Continued)

(56) References Cited

U.S. PATENT DOCUMENTS

2018/0223847 A1* 8/2018 Fujiwara ..... F04B 39/16
2018/0363641 A1* 12/2018 Follmar ..... F04B 49/06
(Continued)

FOREIGN PATENT DOCUMENTS

EP 2392825 A2 * 12/2011 ..... F04B 25/00
EP 4542039 A1 * 4/2025 ..... F04B 49/065
(Continued)

*Primary Examiner* — Thomas Fink
(74) *Attorney, Agent, or Firm* — Studebaker Brackett PLLC

(57) ABSTRACT

A compressor unit includes a first spillback valve, an adjusting means that adjusts a processing amount of hydrogen gas by a succeeding compression stage, an upstream side temperature sensor, and a controller. The controller refers to suction temperature acquired by the upstream side temperature sensor, and can execute a first control and a second control, the first control being of controlling the first spillback valve so that suction temperature falls within a predetermined temperature range, and the second control being of controlling the adjusting means so that a processing amount of the succeeding compression stage is adjusted according to a change amount in pressure in an intermediate flow path caused by the first control. The predetermined temperature range is set to a range higher than reference temperature based on liquefaction temperature of air and less than 0° C.

5 Claims, 16 Drawing Sheets

(58) Field of Classification Search
CPC ..... F04B 49/0822; F04B 2205/065; F04B 2015/0822; F04B 25/00; F04B 25/005
See application file for complete search history.

(56) References Cited

U.S. PATENT DOCUMENTS

| | | | | |
|---|---|---|---|---|
| 2019/0011179 | A1 * | 1/2019 | Tezuka | F25J 1/0277 |
| 2022/0178360 | A1 | 6/2022 | Ukai et al. | |
| 2024/0240629 | A1 * | 7/2024 | Cowan | F04B 49/02 |

FOREIGN PATENT DOCUMENTS

| | | | | |
|---|---|---|---|---|
| JP | H04-012178 | A | 1/1992 | |
| JP | 7085079 | B1 | 6/2022 | |
| WO | WO-2020128197 | A1 * | 6/2020 | F04B 15/08 |

* cited by examiner

COMPRESSOR UNIT

TECHNICAL FIELD

The present invention relates to a reciprocating compressor unit.

BACKGROUND ART

In recent years, in consideration of the environment, use of hydrogen for power generation, fuel for automobiles, and the like is considered, and demand for hydrogen is increasing. Further, low-temperature boil-off gas (BOG) such as liquefied natural gas (LNG) and liquid hydrogen (LH2) is recovered by a compressor and supplied to demand destinations such as an engine. In particular, boil-off gas generated from LH2 has extremely low temperature. For this reason, if a configuration in which the compressor directly suctions boil-off gas is employed, restrictions, such as it is necessary to select a material suitable for cryogenic temperature, employ design conditions that take into account the amount of thermal deformation, and implement strict heat insulation treatment, will be imposed. For example, Patent Literature 1 below discloses a reciprocating compressor for compressing hydrogen gas.

Further, FIG. 9 of Patent Literature 2 below discloses a screw compressor unit having a tandem structure and capable of compressing hydrogen gas. The compressor unit is provided with an intermediate stage spillback valve and a rear stage spillback valve. The intermediate stage spillback valve is controlled based on pressure detected by a pressure sensor arranged in an intermediate stage, and the rear stage spillback valve is controlled based on pressure detected by a pressure sensor arranged in a discharge flow path.

Further, Patent Literature 3 below discloses a multistage compressor for compressing boil-off gas of liquefied natural gas. In this multistage compressor, a cooler is provided between a low pressure stage compression unit and a high pressure stage compression unit, and the cooler is used in a case where temperature of gas discharged from the low pressure stage compressor becomes high.

A problem below is pointed out in Patent Literature 1 below. "In recent years, hydrogen has attracted attention as a new energy source. Even in a case where hydrogen is used as an energy source, hydrogen is assumed to be in a liquefied state like natural gas during storage and transportation. However, hydrogen has a characteristic that its liquefaction temperature is lower than that of air. For this reason, when a facility such as a reciprocating compressor for natural gas or the like is directly applied to hydrogen, there is a possibility that a defect caused by cryogenic liquid hydrogen occurs. For example, liquefied air is generated around a device to which liquid hydrogen is supplied."

For this, Patent Literature 1 describes that "in this reciprocating compressor, a compression unit that compresses gas is housed in a container unit. Then, the container unit forms a vacuum region around the compression unit. Then, the compression unit is thermally insulated from an outer region by the vacuum region. That is, even in a case where cryogenic gas is provided to the compression unit, a surrounding region of the reciprocating compressor is not excessively cooled. Therefore, generation of liquefied air can be suppressed."

However, in general, for a moving machine that generates vibration during operation and a facility that requires regular maintenance through an inspection opening portion (for example, reciprocating compressor and the like), high-performance insulation is extremely difficult. For this reason, it is difficult to appropriately protect a reciprocating compressor unit by a technique disclosed in Patent Literature 1.

CITATION LIST

Patent Literatures

Patent Literature 1: JP 2020-172870 A
Patent Literature 2: JP 7085079 B2
Patent Literature 3: JP H04-12178 A

SUMMARY OF INVENTION

An object of the present invention is to appropriately protect a reciprocating compressor unit from boil-off gas of liquefied hydrogen at cryogenic temperature.

A compressor unit according to one aspect of the present invention is a reciprocating compressor unit configured to recover hydrogen gas that is boil-off gas from a liquid hydrogen storage tank and supply at least a part of the hydrogen gas to a demand destination including at least one of an engine, a power generation facility, and a boiler, the compressor unit including a first compression stage configured to compress hydrogen gas, one or two or more succeeding compression stage configured to further compress hydrogen gas discharged from the first compression stage, a crank mechanism configured to drive the first compression stage and the succeeding compression stage, a first spillback unit including a first spillback flow path and a first spillback valve, the first spillback flow path being for returning a part of hydrogen gas after being discharged from the first compression stage to a suction flow path, and the first spillback valve being for adjusting a spillback amount in the first spillback flow path, an adjusting means for adjusting a processing amount of hydrogen gas by the succeeding compression stage, a pressure sensor arranged on an intermediate flow path between the first compression stage and the succeeding compression stage, an upstream side temperature sensor arranged on the suction flow path between a connection portion with the first spillback flow path and the first compression stage, and a controller configured to control each of the first spillback valve and the adjusting means. Each of the first compression stage and the succeeding compression stage includes a cylinder unit, a piston, a piston rod connecting the piston to the crank mechanism, and rod packing that seals between the piston rod and the cylinder unit. The first compression stage is of an air cooling type and an oil free type. At least a part of the succeeding compression stage includes a leak gas discharge unit configured to return leak gas from the rod packing to the suction flow path. The controller is capable of executing a first control of referring to suction temperature acquired by the upstream side temperature sensor to control the first spillback valve so that the suction temperature falls within a predetermined temperature range, and a second control of controlling the adjusting means so that a processing amount of the succeeding compression stage is adjusted according to a change amount of pressure in the intermediate flow path caused by the first control. The predetermined temperature range is set to a range higher than reference temperature based on liquefaction temperature of air and less than 0° C.

DESCRIPTION OF EMBODIMENTS

Hereinafter, an embodiment will be described with reference to the accompanying drawings. Note that the embodiment below is one example embodying the present invention, and is not intended to limit the technical scope of the present invention.

First Embodiment

A compressor unit according to the present embodiment is configured to recover hydrogen gas, which is boil-off gas, from a liquid hydrogen storage tank, compress the recovered hydrogen gas, and supply the compressed hydrogen gas to a demand destination. The boil-off gas, which is hydrogen gas, is at about −253° C.

Figure 1:
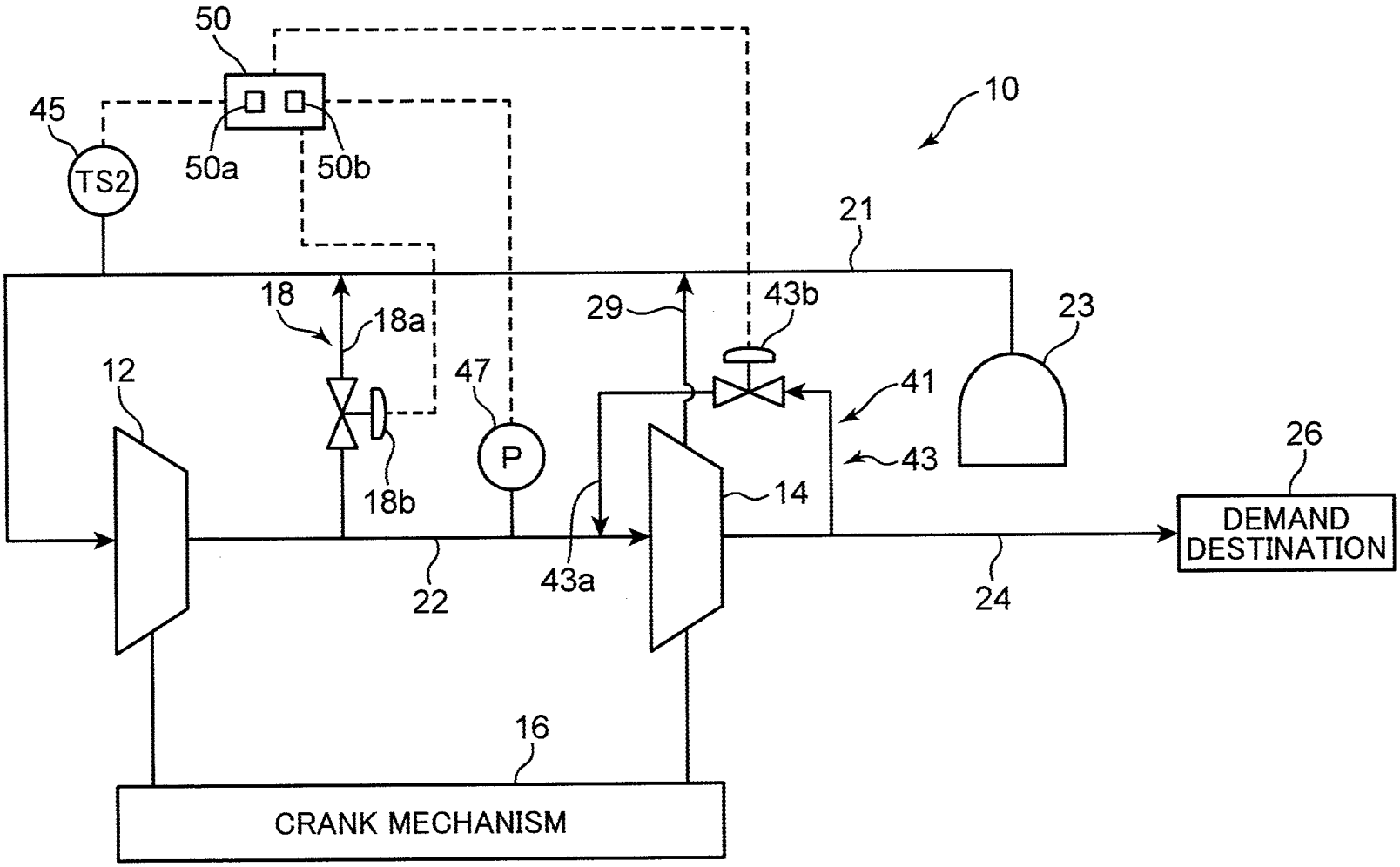
FIG. 1 is a diagram schematically illustrating a compressor unit according to a first embodiment.

As illustrated in FIG. 1, a compressor unit 10 includes a first compression stage 12 that compresses hydrogen gas from a suction flow path 21, a succeeding compression stage 14 connected to the first compression stage 12 via an intermediate flow path 22, and a crank mechanism 16 that drives the first compression stage 12 and the succeeding compression stage 14.

The first compression stage 12 is connected to a liquid hydrogen storage tank 23 via the suction flow path 21. Therefore, boil-off gas that is generated from liquefied gas inside a liquid hydrogen storage tank 23 is suctioned into the first compression stage 12 through the suction flow path 21.

Figure 2:
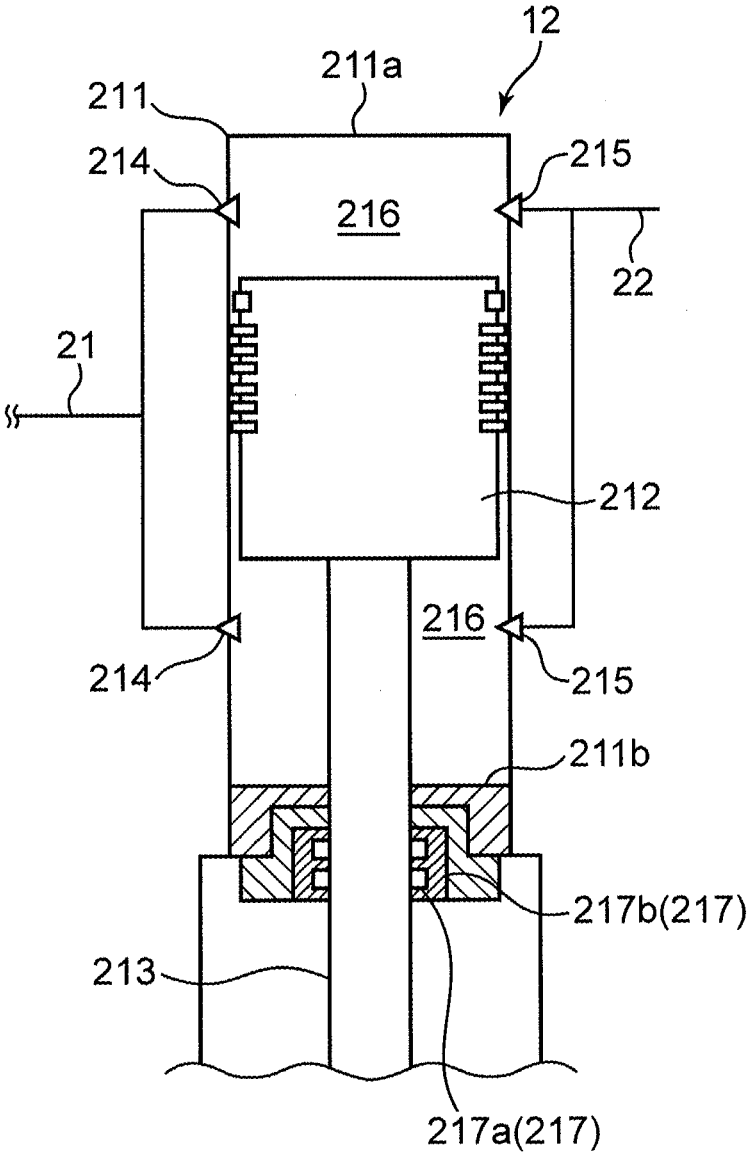
FIG. 2 is a diagram schematically illustrating a first compression stage in the compressor unit.

The first compression stage 12 includes a reciprocating compression mechanism. That is, as illustrated in FIG. 2, the first compression stage 12 includes a cylinder unit 211, a piston 212 arranged in the cylinder unit 211, a piston rod 213 connected to the piston 212, a pair of suction valves 214, and a pair of discharge valves 215. In the cylinder unit 211, a compression chamber 216 is defined between a front head 211*a* and the piston 212 and between a rear head 211*b* and the piston 212. The first compression stage 12 is of an air cooling type and is configured by an oil free compression mechanism that does not use lubricating oil.

The rear head 211*b* of the cylinder unit 211 is provided with rod packing 217 for preventing leakage of hydrogen gas from the compression chamber 216. The rod packing 217 is configured to seal between the piston rod 213 and the cylinder unit 211. The rod packing 217 includes a packing ring 217*a* arranged so as to surround the piston rod 213, and a case 217*b* that holds the packing ring 217*a*.

The piston 212 is connected to the crank mechanism 16 via the piston rod 213. By the piston 212 reciprocating inside the cylinder unit 211, hydrogen gas is compressed inside the compression chamber 216. Although FIG. 2 illustrates the first compression stage 12 having a double acting structure, the first compression stage 12 may employ a single acting structure having a compression chamber only on the front head side or the rear head side.

Note that, in FIG. 1, the first compression stage 12 is illustrated by one trapezoid for convenience, but the first compression stage 12 may have a plurality of the cylinder units 211 instead of having only one of the cylinder unit 211. That is, the first compression stage 12 may be configured such that hydrogen gas is compressed and pressurized by the pistons 212 inside a plurality of the cylinder units 211 connected in parallel. The same applies to another embodiment.

The succeeding compression stage 14 is a compression mechanism for further compressing hydrogen gas discharged from the first compression stage, and hydrogen gas compressed by the succeeding compression stage 14 is discharged to a discharge flow path 24. Hydrogen gas flowing through the discharge flow path 24 is directly or indirectly via another facility sent to a demand destination 26. Examples of the demand destination 26 include a power generation facility, a boiler, an engine of a ship, or the like, and may include a facility that releases gas to the atmosphere, such as a flare facility or a vent.

Figure 3:
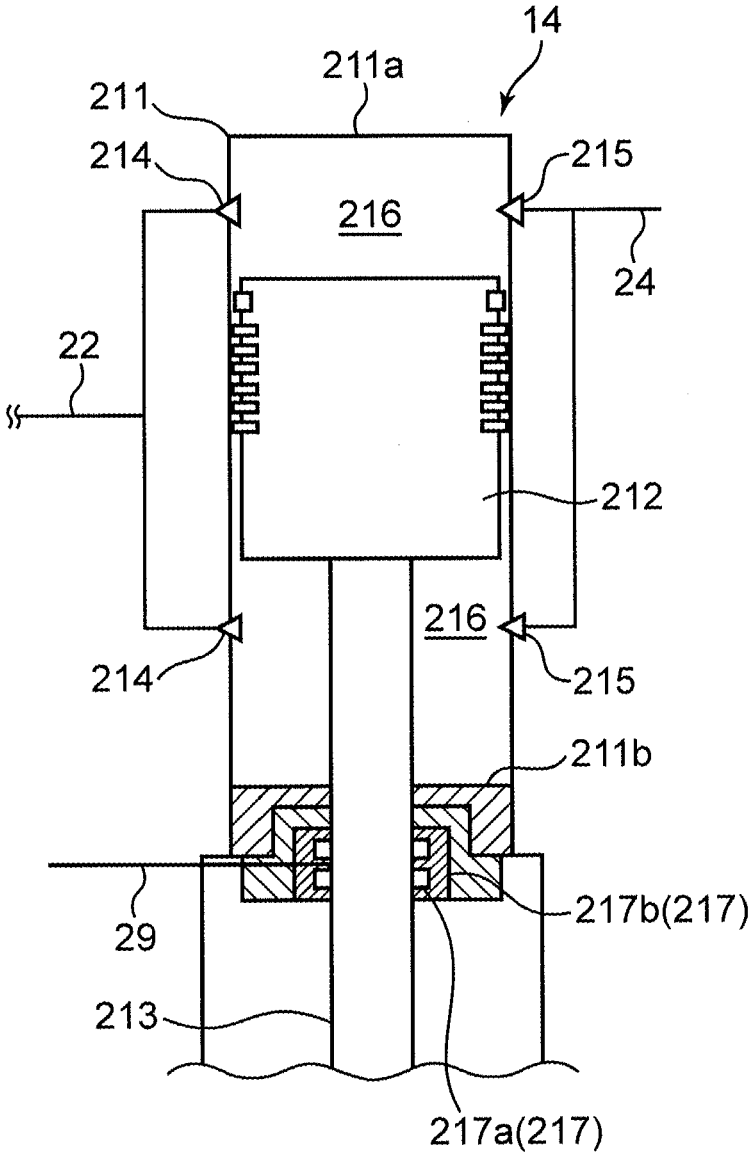
FIG. 3 is a diagram schematically illustrating a succeeding compression stage in the compressor unit.

The succeeding compression stage 14 includes a reciprocating compression mechanism in a similar manner to the first compression stage 12 as illustrated in FIG. 3. The piston 212 of the succeeding compression stage 14 is also connected to the crank mechanism 16 via the piston rod 213. The succeeding compression stage 14 is configured similarly to the first compression stage 12, but the succeeding compression stage 14 is further provided with a leak gas discharge unit 29 that returns leak gas from the rod packing 217 to the suction flow path 21. The leak gas discharge unit 29 may include a pipe member provided to connect the rod packing 217 and the suction flow path 21 to each other.

Note that FIG. 1 illustrates the succeeding compression stage 14 as a single trapezoid for convenience, but the succeeding compression stage 14 does not necessarily need to be a single stage and may include a compression mechanism of a plurality of compression stages. That is, the succeeding compression stage 14 may be configured such that hydrogen gas is sequentially compressed and pressurized by pistons 212 inside a plurality of the cylinder units 211. The same applies to another embodiment. In the succeeding compression stage 14, a compression stage that discharges hydrogen gas at room temperature may be of either an oil free type or a lubricated type.

As illustrated in FIG. 1, the compressor unit 10 includes a first spillback unit 18 that returns a part of hydrogen gas discharged from the first compression stage 12 to the suction flow path 21. The first spillback unit 18 includes a first spillback flow path 18*a* and a first spillback valve 18*b* including a valve having adjustable opening degree arranged on the first spillback flow path 18*a*. One end portion of the first spillback flow path 18*a* is connected to the intermediate flow path 22, while another end portion is connected to the suction flow path 21. That is, hydrogen gas that flows through the first spillback flow path 18*a* merges with hydrogen gas from the liquid hydrogen storage tank 23 in the suction flow path 21. The first spillback valve 18*b* adjusts a spillback amount in the first spillback flow path 18*a* (a flow rate in the first spillback flow path 18*a*).

The compressor unit 10 includes an adjusting means 41 for adjusting a processing amount of hydrogen gas by the succeeding compression stage 14. The adjusting means 41 adjusts a gas processing amount by a method other than adjusting a rotation speed of the crank mechanism 16, and in the present embodiment, the adjusting means includes a spillback unit (second spillback unit 43) that adjusts a processing amount of hydrogen gas so that a flow rate of gas sent from the succeeding compression stage 14 toward the demand destination 26 is adjusted.

The second spillback unit 43 includes a second spillback flow path 43*a* and a second spillback valve 43*b* including a valve having adjustable opening degree arranged on the second spillback flow path 43*a*. One end portion of the second spillback flow path 43*a* is connected to the discharge flow path 24, while another end portion is connected to the intermediate flow path 22. Therefore, a part of hydrogen gas discharged from the succeeding compression stage 14 is returned to the intermediate flow path 22. The second spillback valve 43*b* adjusts a spillback amount in the second spillback flow path 43*a* (a flow rate in the second spillback flow path 43*a*).

The suction flow path 21 is provided with a temperature sensor (upstream side temperature sensor 45) that detects temperature of hydrogen gas flowing through the suction flow path 21. The upstream side temperature sensor 45 is arranged between a connection portion with the first spillback flow path 18*a* and the first compression stage 12 in the suction flow path 21. Therefore, the upstream side temperature sensor 45 can acquire temperature of hydrogen gas that is suctioned into the first compression stage 12 after hydrogen gas from the liquid hydrogen storage tank 23 merges with hydrogen gas from the first spillback flow path 18*a* when hydrogen gas flows through the first spillback flow path 18*a*.

The intermediate flow path 22 is provided with a pressure sensor 47 that detects pressure of hydrogen gas flowing through the intermediate flow path 22. In the intermediate flow path 22, the pressure sensor 47 is located between a connection portion with the first spillback flow path 18*a* and the succeeding compression stage 14. Therefore, the pressure sensor 47 can detect pressure of hydrogen gas after pressure is adjusted by the first spillback unit 18 and introduced into the succeeding compression stage 14.

The pressure sensor 47 outputs a signal indicating detected pressure, and the upstream side temperature sensor 45 outputs a signal indicating acquired temperature (suction temperature TS2). Signals from the pressure sensor 47 and the upstream side temperature sensor 45 are input to the controller 50. The controller 50 is a computer that controls various operations of the compressor unit 10, and functions of the controller 50 executed by the computer include a first controller 50*a* and a second controller 50*b*. The first controller 50*a* is a functional unit configured to control the first spillback valve 18*b* with reference to the suction temperature TS2 acquired by the upstream side temperature sensor 45. The second controller 50*b* is a functional unit configured to control the adjusting means 41 based on pressure detected by the pressure sensor 47.

Figure 4:
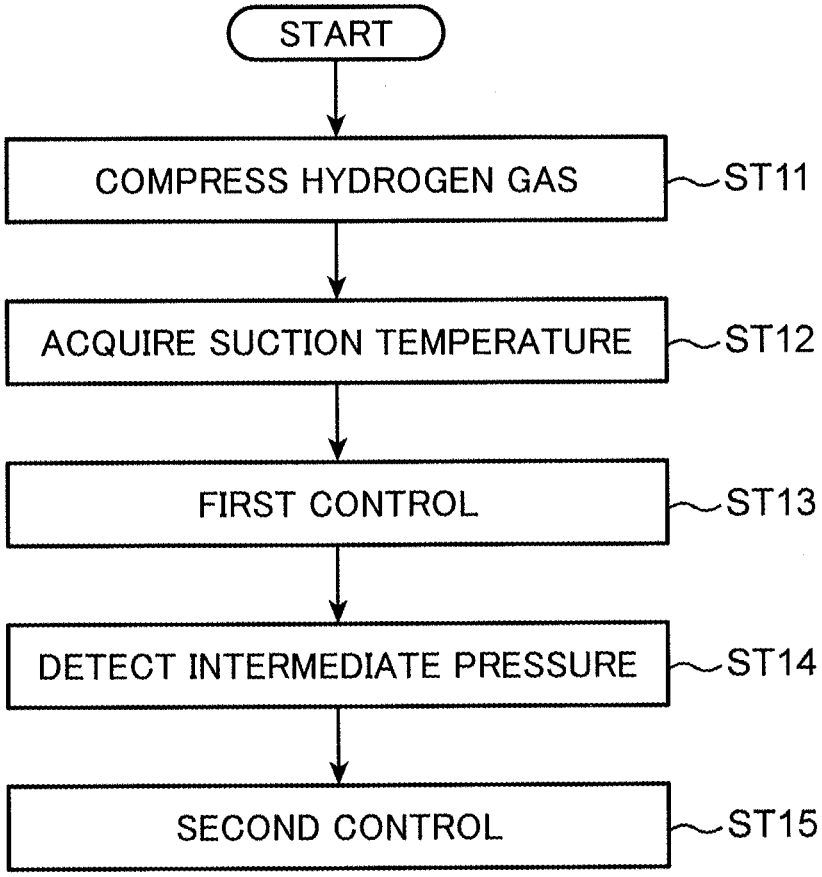
FIG. 4 is a diagram for describing an operation of the compressor unit.

Here, an operation of the compressor unit 10 according to the present embodiment will be described with reference to FIG. 4.

In the first compression stage 12 and the succeeding compression stage 14, the piston 212 reciprocates inside the cylinder unit 211 by operation of the crank mechanism 16. By this, hydrogen gas in the suction flow path 21 is suctioned into the first compression stage 12, and hydrogen gas is compressed in the first compression stage 12. Further, hydrogen gas in the intermediate flow path 22 is suctioned into the succeeding compression stage 14, and hydrogen gas is compressed in the succeeding compression stage 14 (step ST11).

During the operation of the first compression stage 12, temperature (the suction temperature TS2) of hydrogen gas suctioned into the first compression stage 12 is acquired by the upstream side temperature sensor 45 (step ST12). At this time, the first controller 50*a* refers to the suction temperature TS2, and executes first control to control the first spillback valve 18*b* so that the suction temperature TS2 falls within a predetermined temperature range (TTH1≤TS2≤TTH2) (step ST13).

More specifically, in the first control, in a case where TS2<TTH1, the first controller 50*a* controls the first spillback valve 18*b* so that a part of gas in the intermediate flow path 22 is returned to the suction flow path 21 or a return amount increases. This ensures that the suction temperature TS2 is within the above temperature range. Note that in a case where TS2>TTH2, operation of returning a part of gas of the intermediate flow path 22 to the suction flow path 21 is not performed, or an amount returned is reduced.

Here, the predetermined temperature range is set to a range higher than reference temperature based on liquefaction temperature of air and less than 0° C. That is, the lower limit TTH1 and the upper limit TTH2 of the predetermined temperature range are set within a range higher than the reference temperature and less than 0° C. Note that the reference temperature may be temperature within a predetermined range with respect to liquefaction temperature of air (for example, liquefaction temperature of air to liquefaction temperature of air+50° C.).

By this control, the suction temperature TS2, which is temperature of hydrogen gas suctioned into the first compression stage 12, can be kept within an appropriate range. In the first compression stage 12, hydrogen gas from the liquid hydrogen storage tank 23 is not directly introduced, but hydrogen gas with which a part of hydrogen gas compressed in the first compression stage 12 merges and has increased temperature is introduced. For this reason, the first compression stage 12 can be prevented from being exposed to cryogenic hydrogen gas. Moreover, since the suction temperature TS2 is adjusted to be higher than the reference temperature based on liquefaction temperature of air, liquefaction of oxygen can also be prevented. Further, by adjustment to a range less than 0° C., it is possible to prevent density of hydrogen gas suctioned into the first compression stage 12 from excessively decreasing.

By performing the first control, a flow rate of hydrogen gas introduced into the succeeding compression stage 14 in hydrogen gas discharged from the first compression stage 12 is changed. Therefore, during operation of the succeeding compression stage 14, pressure (intermediate pressure) of hydrogen gas introduced into the succeeding compression stage 14 is detected by the pressure sensor 47 (step ST14).

At this time, the second controller 50*b* executes second control of controlling the adjusting means 41 so that a processing amount of the succeeding compression stage 14 is adjusted according to a change amount in gas pressure (intermediate pressure) in the intermediate flow path 22 caused by the first control (step ST15). Specifically, in the second control, in a case where pressure detected by the pressure sensor 47 is lower than a target value, the second spillback valve 43*b* is controlled so that opening degree becomes larger by a predetermined value, and in a case where the detected pressure is higher than a target value, the second controller 50*b* controls the second spillback valve 43*b* so that the opening degree becomes smaller by a predetermined value. Consequently, since pressure at a suction port of the succeeding compression stage 14 falls within a predetermined range, excessive compression operation in the succeeding compression stage 14 can be suppressed. Hydrogen gas compressed in the succeeding compression stage 14 is sent to a demand destination through the discharge flow path 24.

As described above, in the present embodiment, the compressor unit 10 can be protected in a low temperature environment, which contributes to stable recovery of hydrogen gas. Specifically, in the first control, since a flow rate of hydrogen gas returned to the suction flow path 21 by the first spillback unit 18 is adjusted, the suction temperature TS2 of hydrogen gas suctioned into the first compression stage 12 can be adjusted. Further, a temperature range of hydrogen gas suctioned into the first compression stage 12 is adjusted to be higher than reference temperature based on liquefaction temperature of air. For this reason, it is possible to avoid occurrence of liquefaction of oxygen as an oxidizing gas in a suction portion of the first compression stage 12 or the suction flow path 21. That is, it is possible to avoid occurrence of liquefaction of oxygen on an outer surface of a hydrogen gas inflow portion (the periphery of a device to which hydrogen gas is supplied). Further, since the suction temperature TS2 is adjusted to a preset temperature range in a range higher than reference temperature based on liquefaction temperature of air and less than 0° C., it is possible to suppress decrease in processing efficiency of hydrogen gas.

Further, the first spillback unit 18 bypasses only the first compression stage 12. For this reason, as compared with a case where hydrogen gas is spilled back from the discharge flow path 24 of the succeeding compression stage 14 to the suction flow path 21, that is, a case where highest pressure hydrogen gas is returned to the suction flow path 21, deterioration of power of the compressor unit 10 can be suppressed.

Further, since at least the first compression stage 12 is of an oil free type, the risk of oil freezing can be avoided. Furthermore, pressure increases with each succeeding compression stage, and hydrogen gas easily leaks, but since hydrogen gas leaking in the succeeding compression stage 14 is recovered to the suction flow path 21 by the leak gas discharge unit 29, loss of product gas at the time of compression can be reduced. This contributes to efficient recovery of hydrogen gas. Note that the leak gas discharge unit 29 may also be provided in the first compression stage 12.

Figure 5:
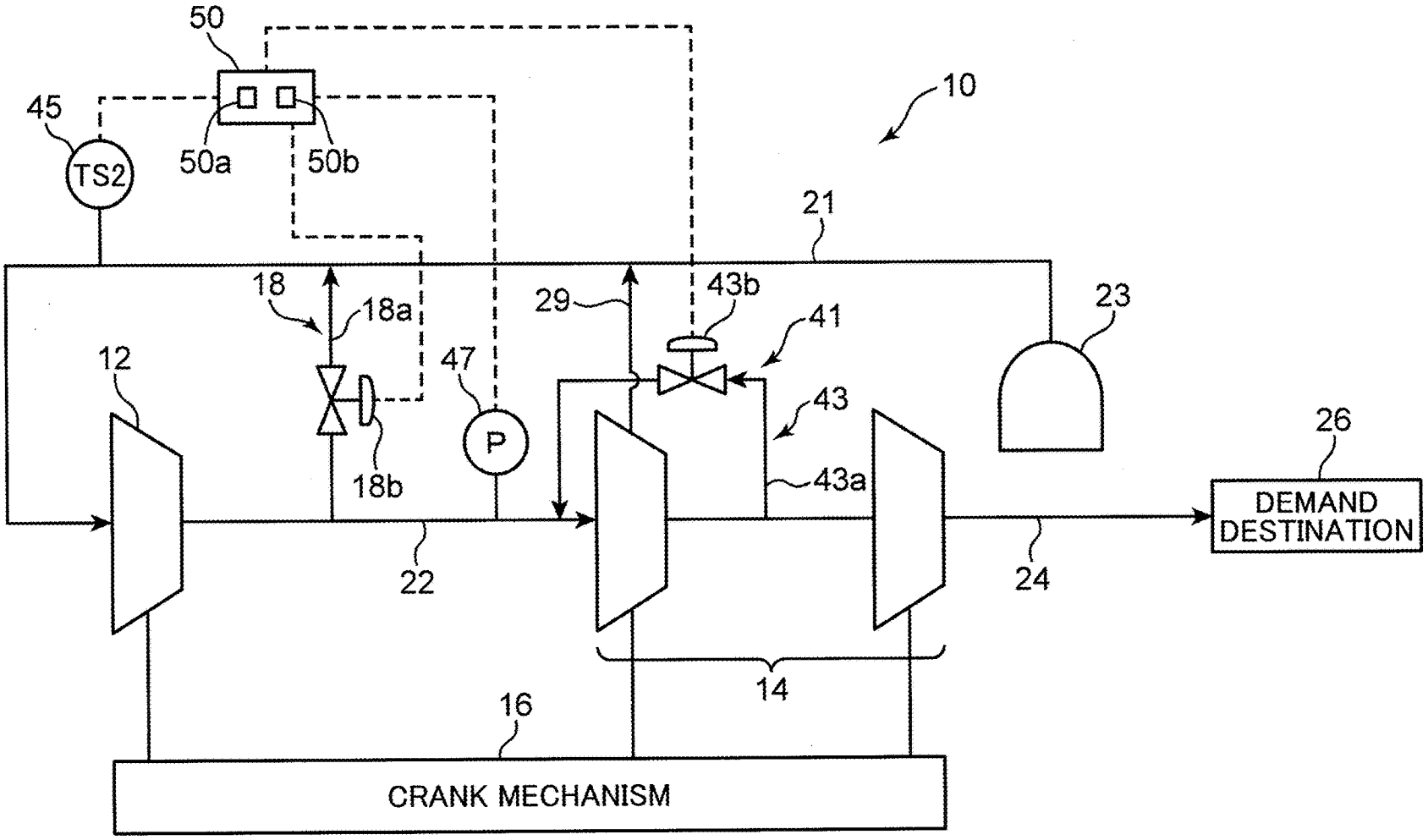
FIG. 5 is a diagram schematically illustrating the compressor unit according to a variation of the first embodiment.
Figure 6:
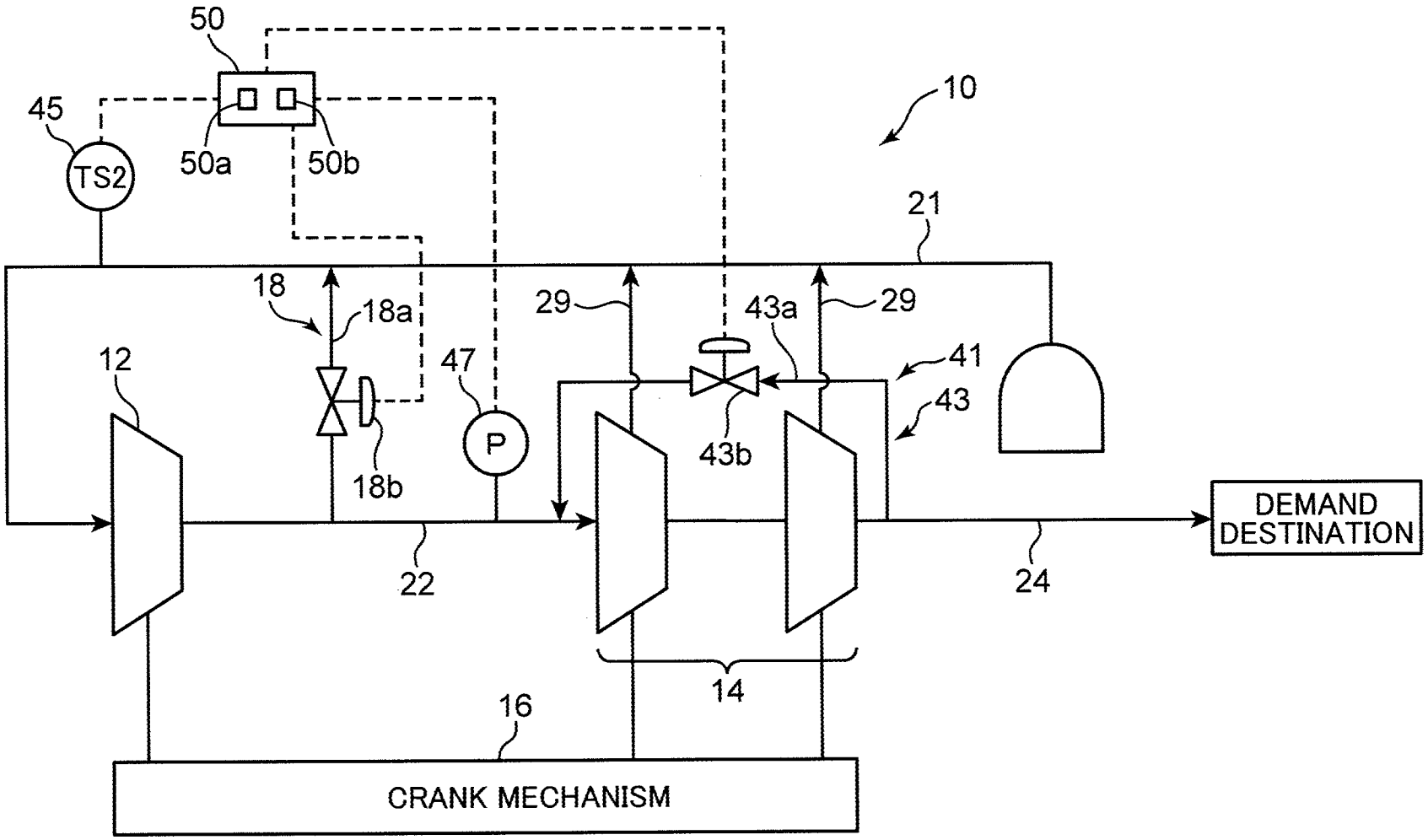
FIG. 6 is a diagram schematically illustrating the compressor unit according to a variation of the first embodiment.
Figure 7:
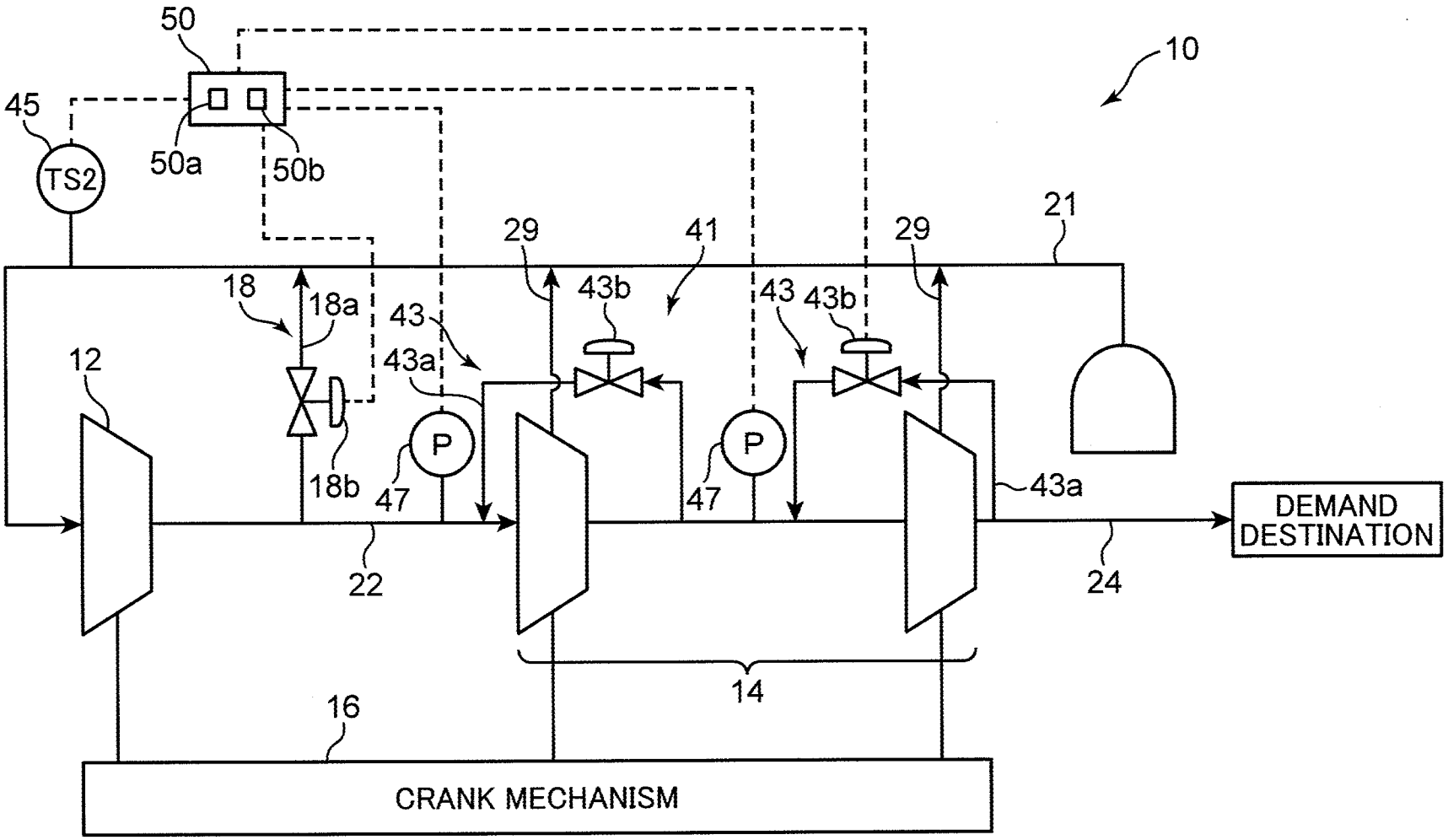
FIG. 7 is a diagram schematically illustrating the compressor unit according to a variation of the first embodiment.

Note that, in the compressor unit 10 illustrated in FIG. 1, the succeeding compression stage 14 has a compression mechanism with one stage, but may have a compression mechanism with a plurality of compression stages as described above. In this case, for example, as illustrated in FIG. 5, the second spillback unit 43 may be provided only in a compression mechanism at a foremost stage in the succeeding compression stage 14, or as illustrated in FIG. 6, the second spillback flow path 43*a* may be configured to bypass all compression mechanisms constituting the succeeding compression stage 14, or as illustrated in FIG. 7, the second spillback unit 43 may be provided in each compression mechanism of the succeeding compression stage 14. The compressor unit 10 may have what is called a tandem structure in which the first compression stage 12 and the succeeding compression stage 14 are arranged in a piston rod direction.

Second Embodiment

Figure 8:
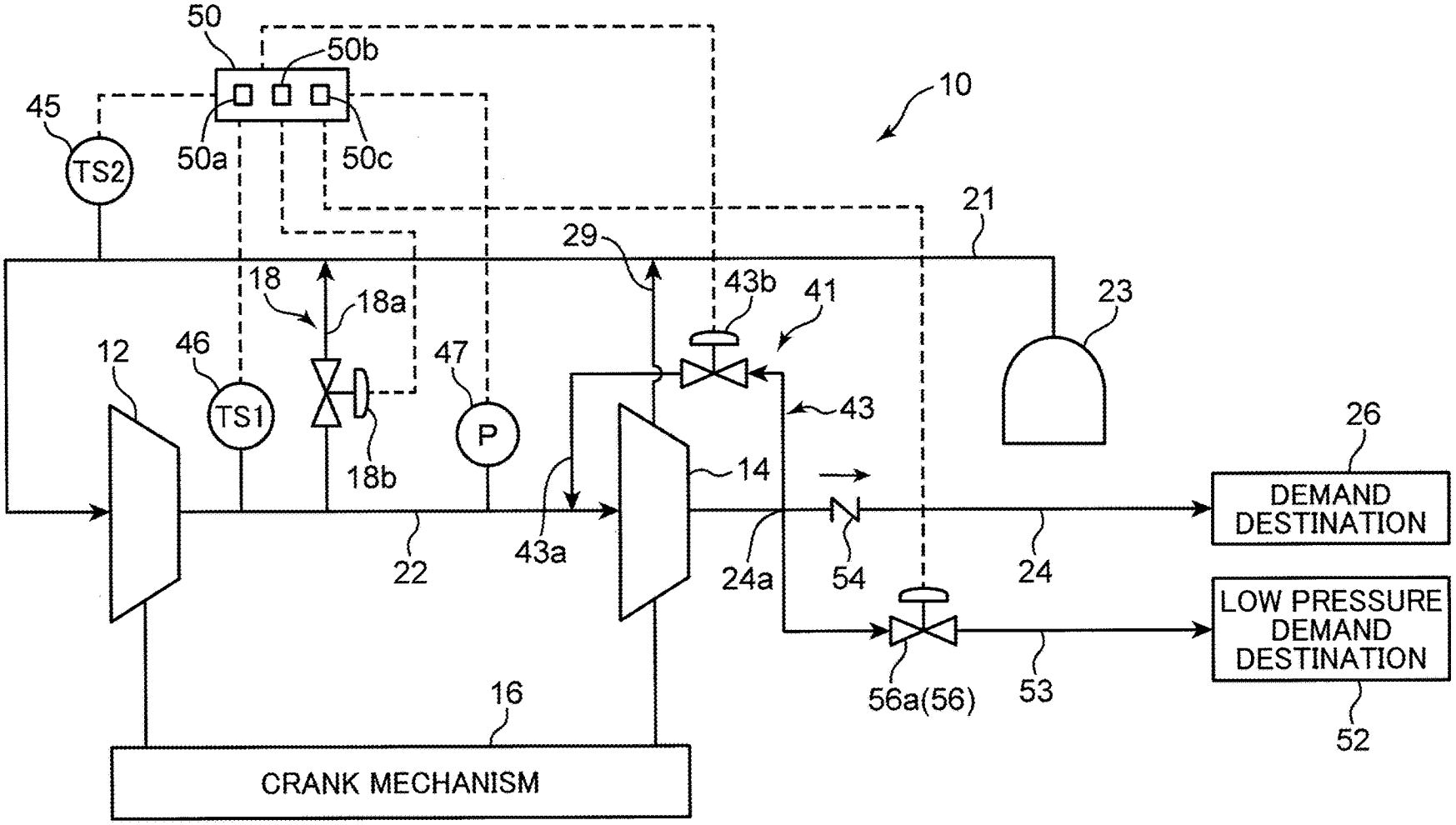
FIG. 8 is a diagram schematically illustrating the compressor unit according to a second embodiment.

As illustrated in FIG. 8, the compressor unit 10 of the second embodiment is different from that of the first embodiment in that, in the intermediate flow path 22, a temperature sensor (downstream side temperature sensor 46) that detects temperature of hydrogen gas flowing through the intermediate flow path 22 is provided, and a low pressure gas discharge path 53 through which hydrogen gas can be discharged to a low pressure demand destination 52 is further provided. Note that, here, the same constituent elements as those of the first embodiment are denoted by the same reference numerals, and omitted from detailed description.

As the low pressure demand destination 52, various facilities may be used as long as the facilities can process hydrogen gas having a pressure lower than pressure of hydrogen gas required by the demand destination 26. For example, a facility for releasing gas to the atmosphere, such as a flare facility or a vent, or another facility in which supply pressure of approximately atmospheric pressure is used may be used.

The low pressure gas discharge path 53 branches from the discharge flow path 24, and a check valve 54 is provided in a portion on the downstream side of a branch point 24*a* where the low pressure gas discharge path 53 branches in the discharge flow path 24. The check valve 54 is a valve that allows hydrogen gas to flow from the branch point 24*a* to the demand destination 26 while preventing flow in the reverse direction. Therefore, it is possible to prevent hydrogen gas from flowing back from the demand destination 26 to the branch point 24*a* and flowing into the low pressure gas discharge path 53.

The compressor unit 10 is provided with a switching means 56 for switching a flowing state of hydrogen gas in the low pressure gas discharge path 53. The switching means 56 includes an on-off valve 56*a* and is provided on the low pressure gas discharge path 53. The switching means 56 switches a flowing state of hydrogen gas in the low pressure gas discharge path 53 between a state (first switching state) in which hydrogen gas discharged from the succeeding compression stage 14 flows through the low pressure gas discharge path 53 and a state (second switching state) in which hydrogen gas discharged from the succeeding compression stage 14 is sent to the demand destination 26 through the discharge flow path 24 without flowing through the low pressure gas discharge path 53. In the first switching state, since the on-off valve 56*a* is opened, hydrogen gas flows through the low pressure gas discharge path 53. On the other hand, although pressure of hydrogen gas at the demand destination 26 is higher than pressure of hydrogen gas at the low pressure demand destination 52, hydrogen gas does not flow toward the demand destination 26 due to an action of the check valve 54. In the second switching state, since the on-off valve 56*a* is closed, hydrogen gas does not flow through the low pressure gas discharge path 53. Therefore, hydrogen gas discharged from the succeeding compression stage 14 is sent to the demand destination 26.

Note that the switching means 56 is not limited to the on-off valve 56*a* provided on the low pressure gas discharge path 53. For example, the switching means 56 may include a three-way valve (not illustrated) and be provided at the branch point 24*a*. In this case, the three-way valve may take either a state (second switching state) in which hydrogen gas discharged from the succeeding compression stage 14 flows toward the demand destination 26 or a state (first switching state) in which hydrogen gas discharged from the succeeding compression stage 14 flows toward the low pressure demand destination 52.

Functions of the controller 50 includes a switching controller 50*c* that controls the switching means 56.

The switching controller 50*c* controls the switching means 56 so that the switching means 56 is in the first switching state in a case where detected temperature TS1 of the downstream side temperature sensor 46 is higher than predetermined first temperature T1 that is higher than 0° C. at the time of startup of the compressor unit 10. In a case where the switching means 56 is in the first switching state, hydrogen gas discharged from the succeeding compression stage 14 is allowed to flow through the low pressure gas discharge path 53, so that hydrogen gas having relatively low pressure is discharged from the succeeding compression stage 14. Consequently, in the succeeding compression stage 14 at the time of startup, in a case where temperature of suction gas in the succeeding compression stage 14 is high, the compressor can be protected from excessive discharge temperature rise caused by pressurizing to high pressure.

Further, the switching controller 50*c* controls the switching means 56 so that the switching means 56 is in the second switching state in a case where the detected temperature TS1 of the downstream side temperature sensor 46 becomes less than the first temperature T1. In a case where the switching means 56 is in the second switching state, hydrogen gas does not flow through the low pressure gas discharge path 53, therefore hydrogen gas discharged from the succeeding compression stage 14 flows toward the demand destination 26 through the discharge flow path 24. In this case, pressure of hydrogen gas discharged from the succeeding compression stage 14 becomes relatively high, but since temperature of hydrogen gas introduced into the succeeding compression stage 14 is not high, temperature in the succeeding compression stage 14 does not become excessively high.

Figure 9:
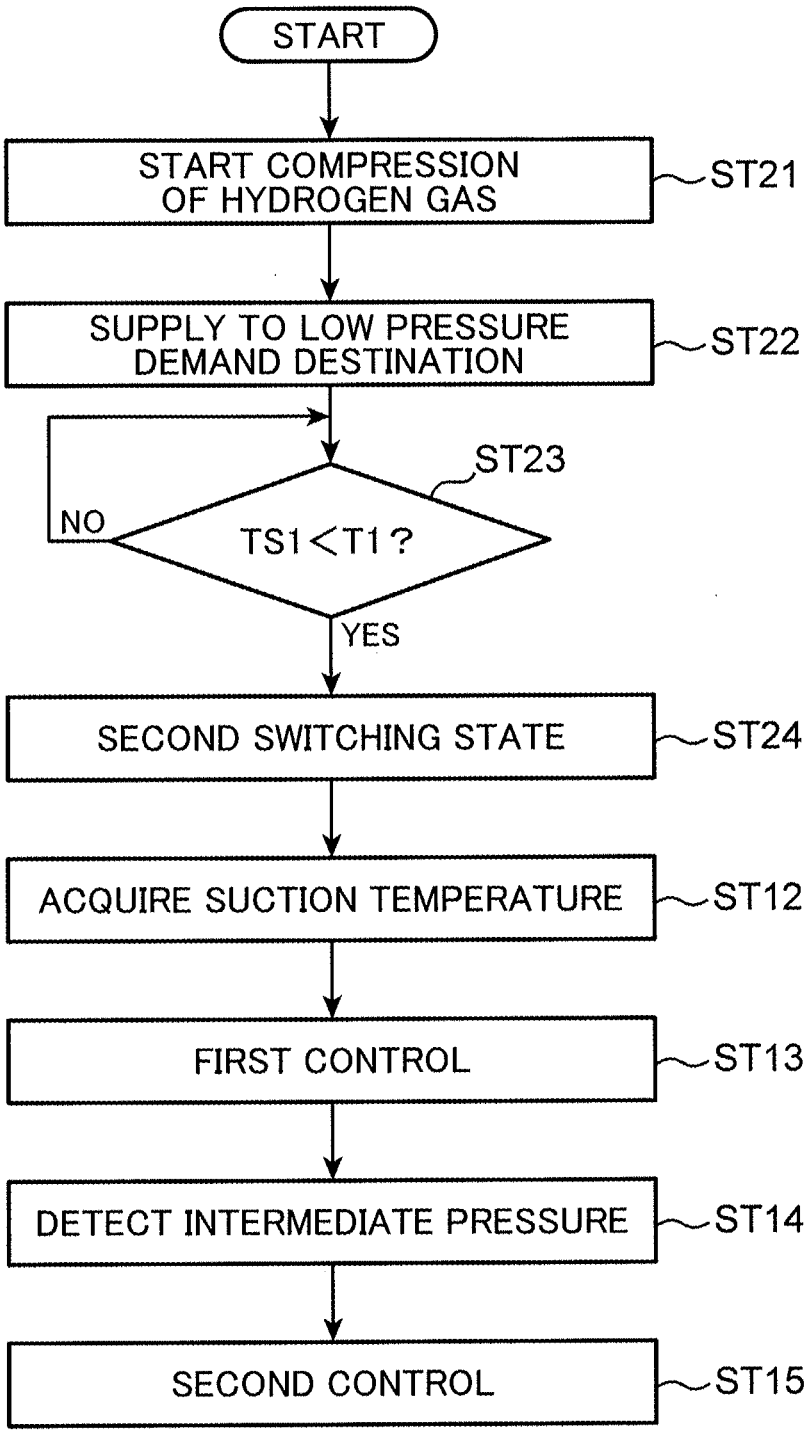
FIG. 9 is a diagram for describing an operation of the compressor unit.

Here, an operation of the compressor unit 10 according to the present embodiment will be described with reference to FIG. 9.

When the compressor unit 10 is started, compression of hydrogen gas in the first compression stage 12 is started (step ST21). At the time of startup of the compressor unit 10, temperature of a piping from the liquid hydrogen storage tank 23 to the first compression stage 12 may be room temperature, so that the switching means 56 is switched to the first switching state at the time of startup of the compressor unit 10. Therefore, hydrogen gas discharged from the succeeding compression stage 14 is sent to the low pressure demand destination 52 through the low pressure gas discharge path 53 (step ST22).

In this state, it is determined whether the detected temperature TS1 of the downstream side temperature sensor 46 is less than the first temperature T1 (step ST23). As long as the detected temperature TS1 is equal to or higher than the first temperature T1 (NO in step ST23), step ST23 is repeatedly executed. When the detected temperature TS1 is less than the first temperature T1 (YES in step ST23), the switching controller 50*c* of the controller 50 controls the switching means 56 so that the switching means 56 is in the second switching state (step ST24). Consequently, a state (startup operation) in which hydrogen gas discharged from the succeeding compression stage 14 flows to the low pressure gas discharge path 53 is stopped, and a steady operation in which hydrogen gas is supplied to the demand destination 26 is performed.

In the steady operation, temperature (the suction temperature TS2) of hydrogen gas suctioned into the first compression stage 12 is acquired by the upstream side temperature sensor 45 (step ST12). At this time, the first controller 50*a* refers to the suction temperature TS2, and executes the first control for controlling the first spillback valve 18*b* as in the first embodiment (step ST13).

Since a flow rate of hydrogen gas introduced into the succeeding compression stage 14 in hydrogen gas discharged from the first compression stage 12 is changed as the first control is performed, pressure (intermediate pressure) of hydrogen gas introduced into the succeeding compression stage 14 is detected by the pressure sensor 47 (step ST14). At this time, similarly to the first embodiment, the second controller 50*b* executes second control of controlling the adjusting means 41 so that a processing amount of the succeeding compression stage 14 is adjusted according to a change amount in pressure (intermediate pressure) in the intermediate flow path 22 caused by the first control (step ST15).

Therefore, in the present embodiment, in a case where hydrogen gas in a piping on the liquid hydrogen storage tank 23 side rises to a positive temperature region (temperature region higher than 0° C.) at the time of startup, hydrogen gas discharged from the succeeding compression stage 14 is delivered to the low pressure demand destination 52. For this reason, it is possible to more effectively prevent excessive temperature increase of hydrogen gas in the succeeding compression stage 14. That is, in the reciprocating compressor unit 10, hydrogen gas at pressure corresponding to pressure set by a supply destination of hydrogen gas is delivered. For this reason, the switching means 56 is controlled such that hydrogen gas is delivered to the low pressure demand destination 52, so that discharged gas pressure by the succeeding compression stage 14 is reduced, and the compressor is protected from excessive discharge temperature increase due to pressure increase to high pressure. By this, the succeeding compression stage 14 can be more reliably protected. Further, startup of the compressor unit 10 can be performed promptly. Further, the compressor unit 10 can be protected in a low temperature environment.

Note that, although other configurations, operations, and effects are not described, the description of the first embodiment can be applied to the second embodiment.

Third Embodiment

Figure 10:
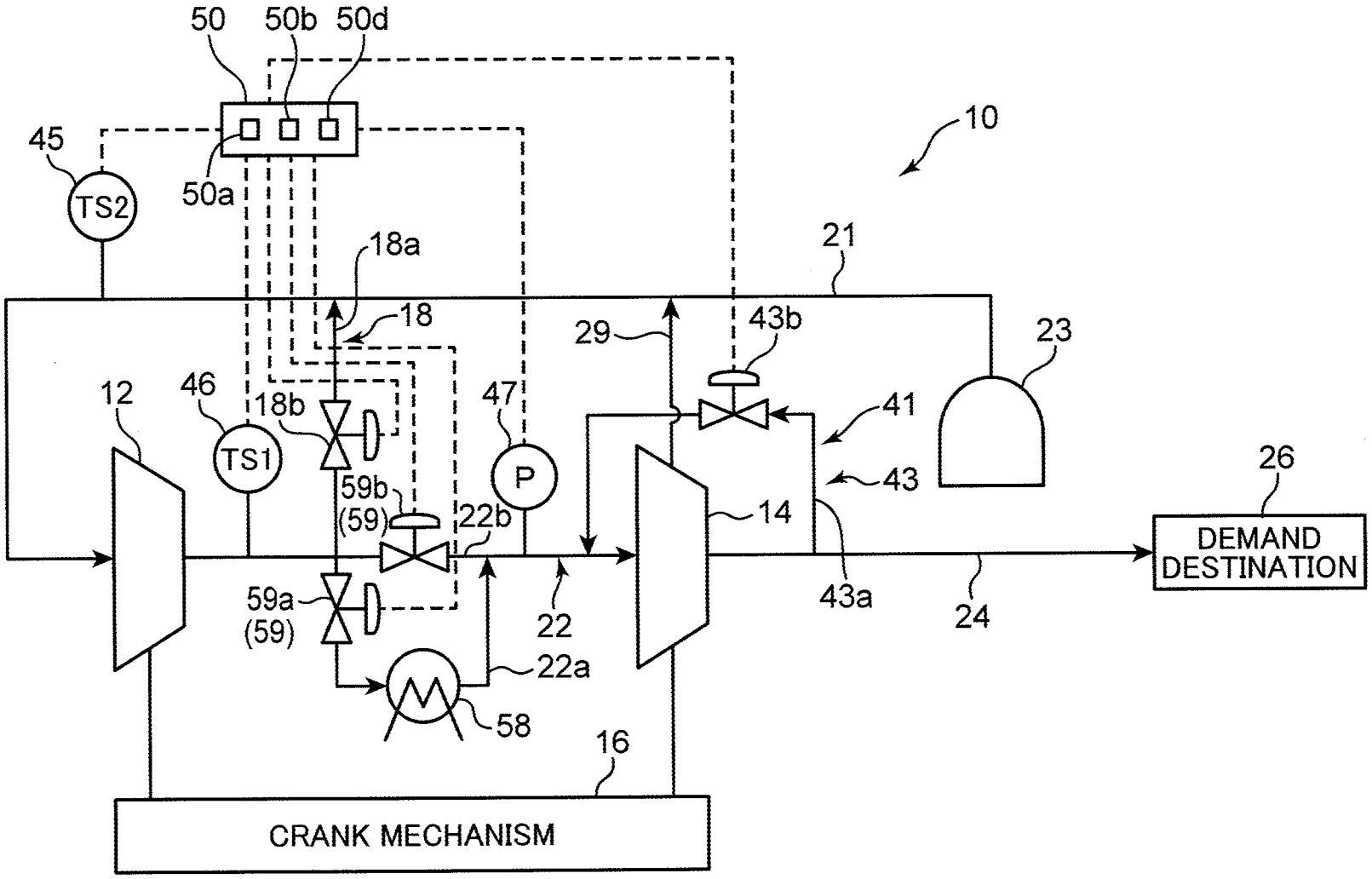
FIG. 10 is a diagram schematically illustrating the compressor unit according to a third embodiment.

As illustrated in FIG. 10, the compressor unit 10 according to a third embodiment is different from that of the first embodiment in that a cooler 58 and a cooler switching means 59 are provided. Note that, here, the same constituent elements as those of the first embodiment are denoted by the same reference numerals, and omitted from detailed description.

The cooler 58 is arranged between the first compression stage 12 and the succeeding compression stage 14. That is, in the third embodiment, the intermediate flow path 22 includes branched flow paths (a first flow path 22*a* and a second flow path 22*b*) at its intermediate portion, and the cooler 58 is arranged in one of the flow paths (the first flow path 22*a*).

The cooler switching means 59 is configured to be able to switch a path of hydrogen gas between a state (first switching state) in which hydrogen gas discharged from the first compression stage 12 flows into the succeeding compression stage 14 by passing through the cooler 58 and a state (second switching state) in which hydrogen gas flows into the succeeding compression stage 14 without passing through the cooler 58. The cooler switching means 59 includes a first on-off valve 59*a* provided on the first flow path 22*a* and a second on-off valve 59*b* provided on the second flow path 22*b*. Note that the cooler switching means 59 is not limited to the configuration including two of the on-off valves 59*a* and 59*b*. For example, the cooler switching means 59 include a three-way valve arranged at a connection portion between the first flow path 22*a* and the second flow path 22*b*.

The connection portion of the first spillback flow path 18*a* in the intermediate flow path 22 may be on the upstream side or the downstream side of a connection portion between the first flow path 22*a* and the second flow path 22*b* as long as the connection portion of the first spillback flow path 18*a* is between the first compression stage 12 and the succeeding compression stage 14.

Functions of the controller 50 includes a cooler controller 50*d* capable of controlling switching of the cooler switching means 59.

In a case where the detected temperature TS1 of the downstream side temperature sensor 46 is higher than the predetermined first temperature T1 that is higher than 0° C. at the time of startup, the cooler controller 50*d* controls the cooler switching means 59 so that hydrogen gas flows through the cooler 58. That is, in a case where the detected temperature TS1 of the downstream side temperature sensor 46 is higher than the first temperature T1, the cooler switching means 59 is controlled such that hydrogen gas discharged from the first compression stage 12 is cooled by the cooler 58 before being suctioned into the succeeding compression stage 14.

Further, in a case where the detected temperature TS1 of the downstream side temperature sensor 46 is less than the first temperature T1, the cooler controller 50*d* controls the cooler switching means 59 so that hydrogen gas does not flow through the cooler 58.

Figure 11:
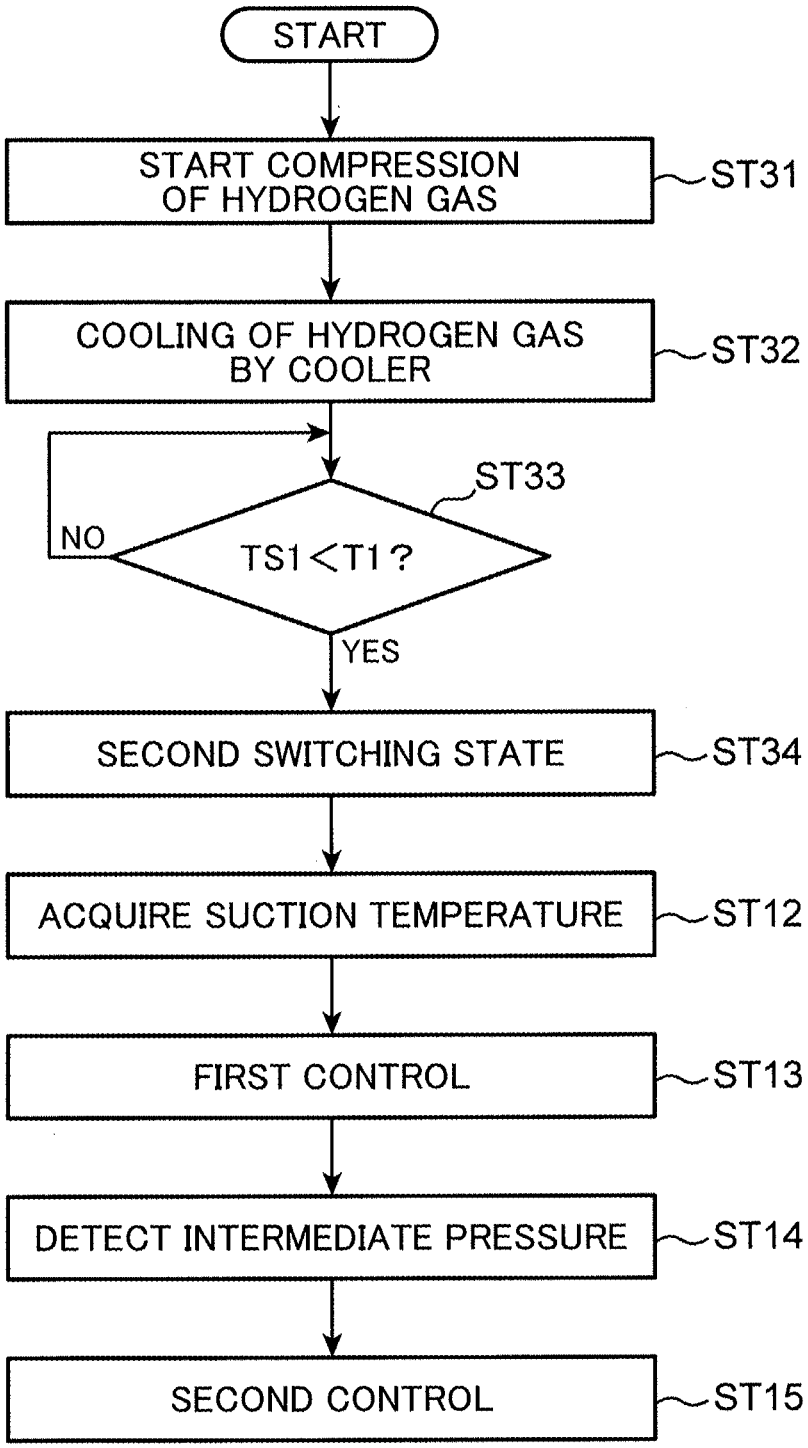
FIG. 11 is a diagram for describing an operation of the compressor unit.

Here, an operation of the compressor unit 10 according to the present embodiment will be described with reference to FIG. 11.

When the compressor unit 10 is started, compression of hydrogen gas in the first compression stage 12 is started (step ST31). At the time of startup of the compressor unit 10, temperature of a piping from the liquid hydrogen storage tank 23 to the first compression stage 12 may be room temperature, so that the cooler switching means 59 is switched to the first switching state at the time of startup of the compressor unit 10. For this reason, hydrogen gas discharged from the first compression stage 12 flows into the first flow path 22*a* of the intermediate flow path 22, is cooled by the cooler 58, and is then introduced into the succeeding compression stage 14 (step ST32).

In this state, it is determined whether the detected temperature TS1 of the downstream side temperature sensor 46 is less than the first temperature T1 (step ST33). As long as the detected temperature TS1 is equal to or higher than the first temperature T1 (NO in step ST33), step ST33 is repeatedly executed. When the detected temperature TS1 is less than the first temperature T1 (YES in step ST33), the cooler controller 50*d* of the controller 50 controls the cooler switching means 59 so that the cooler switching means 59 is in the second switching state (step ST34). Consequently, a state (startup operation) in which hydrogen gas discharged from the first compression stage 12 is cooled by the cooler 58 is stopped, and a steady operation in which hydrogen gas discharged from the first compression stage 12 is introduced into the succeeding compression stage 14 without being cooled by the cooler 58 is performed.

In the steady operation, temperature (the suction temperature TS2) of hydrogen gas suctioned into the first compression stage 12 is acquired by the upstream side temperature sensor 45 (step ST12). At this time, the first controller 50*a* executes the first control similarly to the first embodiment (step ST13). Consequently, the suction temperature TS2 of hydrogen gas suctioned into the first compression stage 12 can be kept within an appropriate range.

By performing the first control, a flow rate of hydrogen gas introduced into the succeeding compression stage 14 in hydrogen gas discharged from the first compression stage 12 is changed. For this reason, pressure (intermediate pressure) of hydrogen gas introduced into the succeeding compression stage 14 is detected by the pressure sensor 47 (step ST14), and the second controller 50*b* executes the second control for controlling the adjusting means 41 as in the first embodiment (step ST15).

Therefore, according to the present embodiment, in a case where hydrogen gas in a piping on the liquid hydrogen storage tank 23 side increases to a positive temperature region at the time of startup, hydrogen gas discharged from the first compression stage 12 is cooled by the cooler 58. Consequently, it is possible to prevent excessive temperature increase of hydrogen gas in the succeeding compression stage 14. Therefore, this contributes to stable recovery of hydrogen gas. That is, the succeeding compression stage 14 can be protected. Further, startup of the compressor unit 10 can be performed promptly. Further, the compressor unit 10 can be protected in a low temperature environment.

Although other configurations, operations, and effects are not described, the description of the first and second embodiments can be applied to the third embodiment.

Fourth Embodiment

Figure 12:
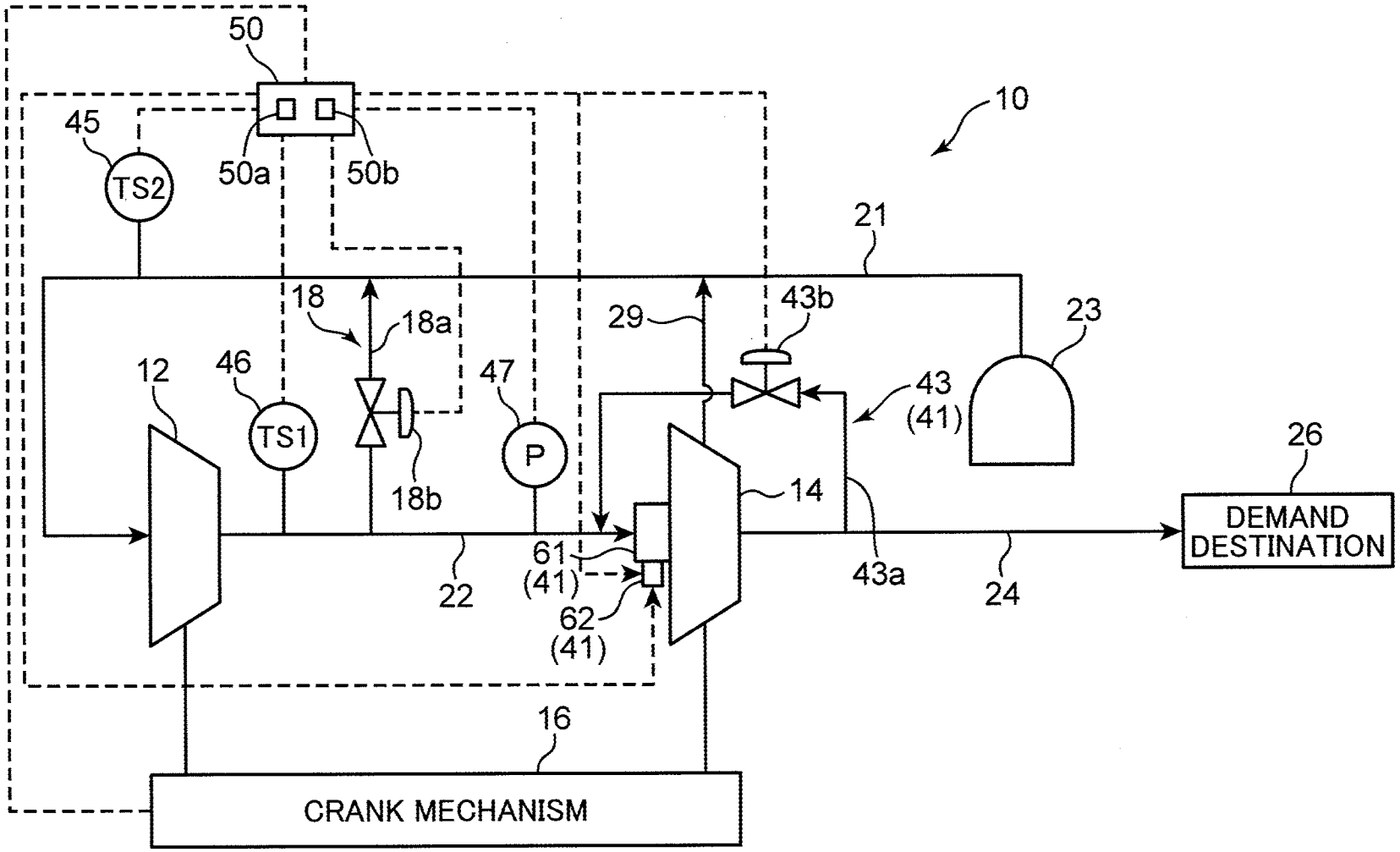
FIG. 12 is a diagram schematically illustrating the compressor unit according to a fourth embodiment.

As illustrated in FIG. 12, the compressor unit 10 according to a fourth embodiment is different from that of the first embodiment in that the adjusting means 41 includes the second spillback unit 43, an on-off type suction valve unloader 61, and a drive device 62. Here, the same constituent elements as those of the first to third embodiments are denoted by the same reference numerals, and omitted from detailed description.

When the suction valve unloader 61 is driven by the drive device 62, a valve plate of the suction valve 214 is maintained in an open state, and a state in which a function of the check valve cannot be performed is created. That is, in a case where the piston 212 is in a suction stroke in a state where the unloader 61 is not driven, pressure of the compression chamber 216 is lower than pressure of the intermediate flow path 22, which is a path on the suction side, and the suction valve 214 is in an open state. Therefore, gas is introduced to the compression chamber 216 side. On the other hand, in a case where the piston 212 is in a compression stroke, pressure in the compression chamber 216 is higher than pressure in the intermediate flow path 22, and the suction valve 214 is in a closed state. On the other hand, when the suction valve unloader 61 is driven by the drive device 62, a function of the check valve does not work.

The adjusting means 41 is provided in at least one of the succeeding compression stages 14, and the suction valve unloader 61 is attached to the suction valve 214 of the succeeding compression stage 14. The suction valve unloader is attached to each of a front head side compression chamber and a rear head side compression chamber of the cylinder unit 211, and can be operated independently of each other. A state in which both do not operate is referred to as 100% load, and a state in which either one operates is referred to as 50% load.

The suction valve unloader 61 is driven by the drive device 62 by air or gas such as nitrogen. The suction valve unloader 61 is driven by the drive device 62 to bring the suction valve 214 (see FIG. 3) into a state in which the compression chamber 216 is opened and closed with respect to the suction flow path 21 according to differential pressure between the compression chamber 216 and the suction flow path 21 (load state), or into a state in which a space between the compression chamber 216 and the suction flow path 21 is maintained in an open state (unload). For example, when air or gas such as nitrogen is not applied to the drive device 62, the suction valve unloader 61 causes the suction valve 214 to be in a free state such that the compression chamber 216 is in an openable and closable state according to differential pressure between the compression chamber 216 and the suction flow path 21. On the other hand, in a case where air or gas such as nitrogen is applied to the drive device 62, the suction valve unloader 61 forcibly maintains the suction valve 214 in an open state despite the differential pressure between the compression chamber 216 and the suction flow path 21 to normally close the compression chamber 216.

Further, a signal indicating a state of the suction valve unloader 61 and an opening degree signal of the second spillback valve 43*b* are sent to the controller 50 and used for control in the controller 50. That is, the controller 50 estimates an amount of gas to be spilled back from opening degree of the second spillback valve 43*b*, and in a case where opening degree of the second spillback valve 43*b* exceeds a preset opening degree threshold (for example, approximately 50%), the controller 50 lowers load of the succeeding compression stage 14 to 50% by the suction valve unloader 61. Consequently, since a discharge amount of the succeeding compression stage 14 is reduced, a spillback amount in the second spillback unit 43 can be reduced. As a result, power of the succeeding compression stage 14 can be reduced as compared with when the suction valve 214 is in a free state.

Figure 13:
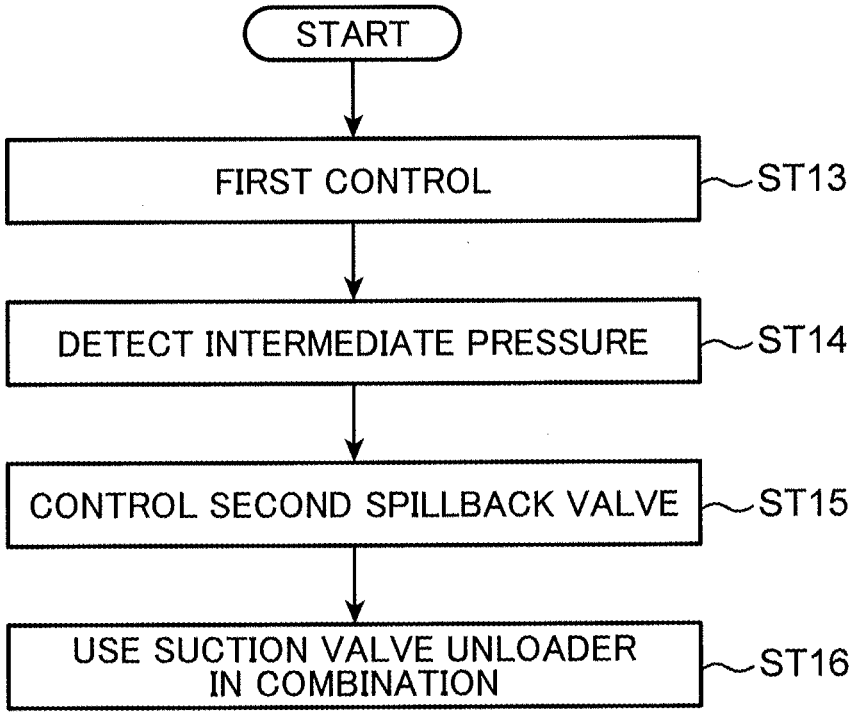
FIG. 13 is a diagram for describing an operation of the compressor unit.

As illustrated in FIG. 13, the first controller 50*a* of the controller 50 refers to the suction temperature TS2, and executes the first control to control the first spillback valve 18*b* so that the suction temperature TS2 falls within a predetermined temperature range (step ST13). By performing the first control, a flow rate of hydrogen gas introduced into the succeeding compression stage 14 in hydrogen gas discharged from the first compression stage 12 is changed. Therefore, during operation of the succeeding compression stage 14, pressure (intermediate pressure) of hydrogen gas introduced into the succeeding compression stage 14 is detected by the pressure sensor 47 (step ST14).

The second controller 50*b* of the controller 50 controls the second spillback valve 43*b* in accordance with a change amount in pressure in the intermediate flow path 22 caused by the first control (step ST15). For example, in a case where pressure detected by the pressure sensor 47 is lower than a target value, the second spillback valve 43*b* is controlled so that opening degree increases by a predetermined value. Then, the second controller 50*b* controls the drive device 62 so that the suction valve unloader 61 is used in combination when opening degree of the second spillback valve 43*b* reaches a preset value (step ST16).

Figure 14:
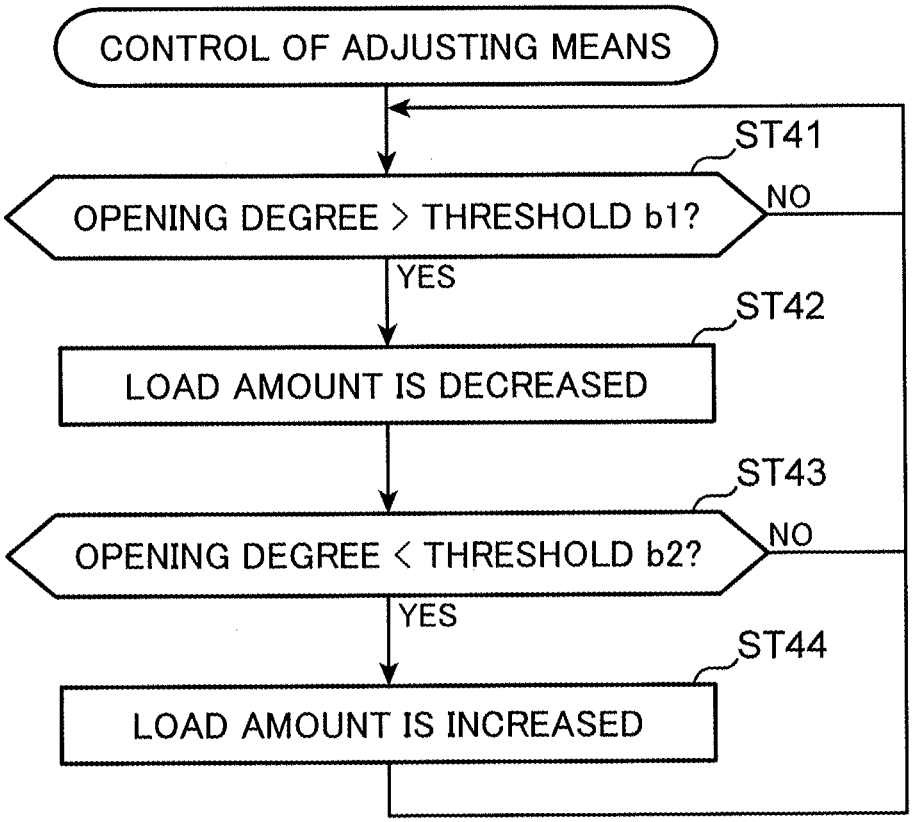
FIG. 14 is a diagram for describing an operation of the compressor unit.

Specifically, as illustrated in FIG. 14, the controller 50 compares opening degree of the second spillback valve 43*b* input to the controller 50 with a preset opening degree threshold b1, and in a case where a state of the second spillback valve 43*b* (opening degree of the valve) becomes larger than the opening degree threshold b1 (spillback amount is large) (Yes in step ST41), the controller 50 controls the drive device 62 so that a load amount of the suction valve unloader 61 (for example, the suction valve unloader on the front head side) is decreased (step ST42). Consequently, a load amount of the succeeding compression stage 14 decreases (from 100% to 50%). In a case where opening degree of the second spillback valve 43*b* is smaller than an opening degree threshold b2 (Yes in step ST43), the controller 50 controls the drive device 62 so that a load amount of the suction valve unloader 61 is increased (step ST44). Consequently, a load amount of the succeeding compression stage 14 is increased (from 50% to 100%). This allows reduction in power by lowering load of the succeeding compression stage 14 in a case where spillback is excessive.

Although other configurations, operations, and effects are not described, the description of the first to third embodiments can be applied to the fourth embodiment.

Fifth Embodiment

Figure 15:
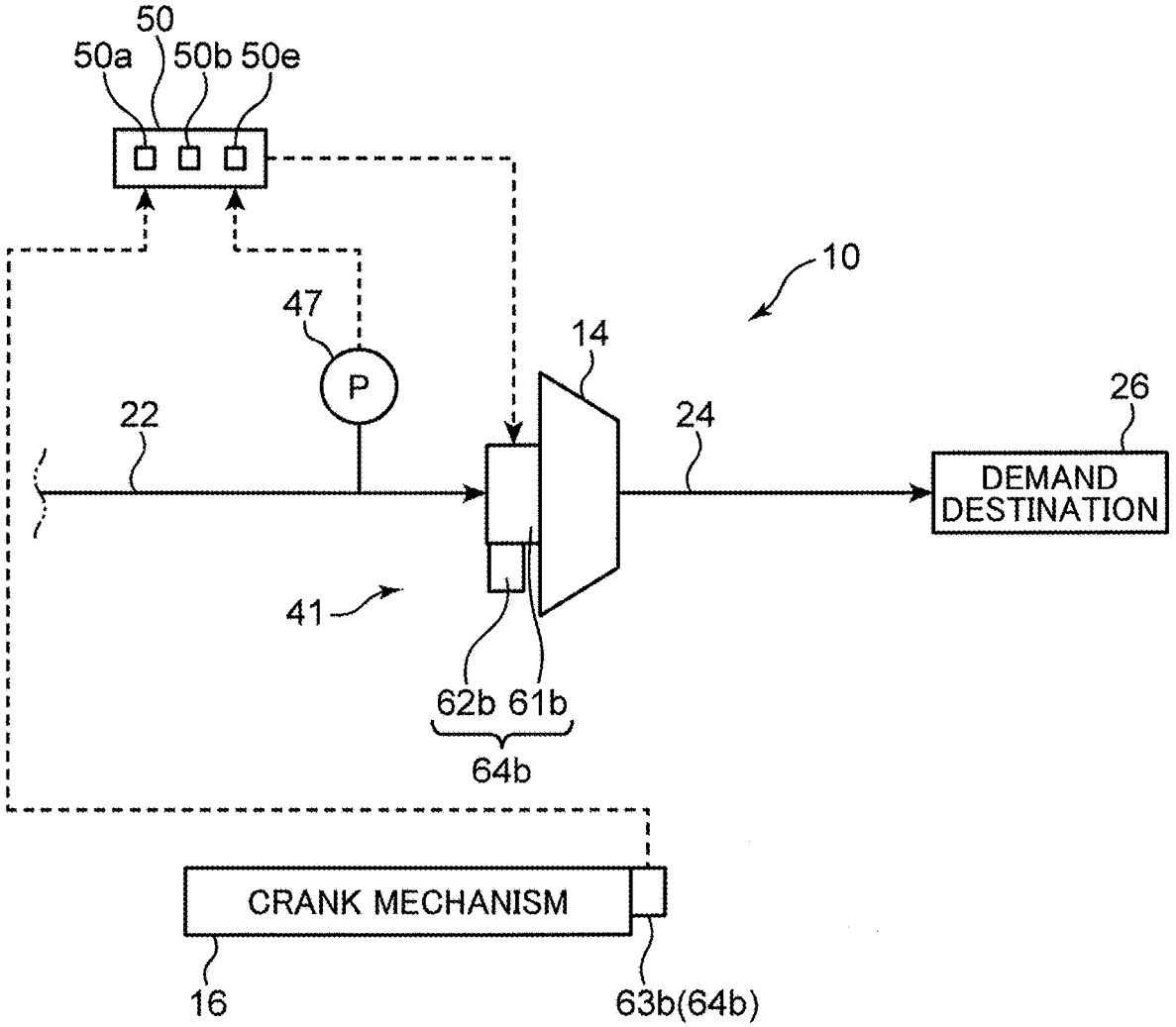
FIG. 15 is a diagram schematically illustrating the compressor unit according to a fifth embodiment.

In the fourth embodiment, the adjusting means 41 includes the second spillback unit 43, the on-off type suction valve unloader 61, and the drive device 62. On the other hand, in the compressor unit 10 according to a fifth embodiment, as illustrated in FIG. 15, the adjusting means 41 does not include the second spillback unit 43, but includes a stepless capacity adjustment device 64*b*. Functions of the controller 50 include a stepless capacity adjustment controller 50*e* capable of controlling the stepless capacity adjustment device 64*b*. Here, the same constituent elements as those of the first to fourth embodiments are denoted by the same reference numerals, and omitted from detailed description.

The stepless capacity adjustment device 64*b* includes a suction valve unloader 61*b*, a drive device 62*b*, and a detector 63*b* that detects rotation of a crankshaft of the crank mechanism 16. The suction valve unloader 61*b* is driven by the hydraulic or electric drive device 62*b*, and can maintain or release an open state of a valve plate of the suction valve 214 at a speed faster than the time required by the piston 212 to reciprocate. Further, the controller 50 performs computational processing to estimate a position of the piston 212 based on a signal transmitted from the detector 63*b* installed in the crank mechanism 16.

In the cylinder unit 211 of the succeeding compression stage 14, the suction valve 214 installed between the intermediate flow path 22, which is a flow path on the suction side, and the compression chamber 216 includes a valve plate that opens and closes a gas passage, a valve body that houses the valve plate, and the like. Similarly to the check valve, the suction valve 214 has a structure in which in a case where upstream pressure is higher than the downstream side, the valve plate is in an open state by the differential pressure, and in a case where pressure on the downstream side is higher, gas does not flow.

When the suction valve unloader 61*b* is driven by the drive device 62*b*, the valve plate of the suction valve 214 is maintained in an open state, and a state in which a function of the check valve cannot be performed is created. Note that, in a case where the piston 212 is in a suction stroke in a state where the unloader 61*b* is not driven, pressure of the compression chamber 216 is lower than pressure of the intermediate flow path 22, which is a path on the suction side, and then the suction valve 214 is in an open state. Consequently, gas is introduced to the compression chamber 216 side. On the other hand, in a case where the piston 212 is in a compression stroke, pressure in the compression chamber 216 is higher than pressure in the intermediate flow path 22, and then the suction valve 214 is in a closed state.

The stepless capacity adjustment controller 50*e* of the controller 50 drives the drive device 62*b* so that the operation timing of the suction valve unloader 61*b* is adjusted in conjunction with rotational motion of a crankshaft in the crank mechanism 16. Specifically, at the beginning of a compression stroke, an open state of the suction valve 214 is maintained by the stepless capacity adjustment device 64*b*. Consequently, a part of gas introduced into the compression chamber 216 is returned to the intermediate flow path 22 side. Then, the open state is released from the intermediate position of the compression stroke, so that the suction valve 214 is closed, and gas remaining in the compression chamber 216 at that time is compressed and delivered. In a next piston suction stroke, the drive device 62*b* is driven again, and an open state is released after a compression stroke of the piston 212 starts. This is repeated in accordance with reciprocating motion of the piston.

If the release timing is advanced, a delivery amount increases, and if the release timing is delayed, a delivery amount decreases, therefore the same function as the second spillback unit 43 can be performed. That is, since a processing amount of the succeeding compression stage 14 is adjusted according to a change amount of pressure in the intermediate flow path 22 caused by the first control, an effect of reducing power is large.

Note that, although other configurations, operations, and effects are not described, the description of the first to fourth embodiments can be applied to the fifth embodiment.

It should be understood that the embodiment disclosed this time is illustrative in all respects and is not restrictive. The present invention is not limited to the above embodiment, and various changes, improvements, and the like can be made without departing from the gist of the present invention.

Figure 16:
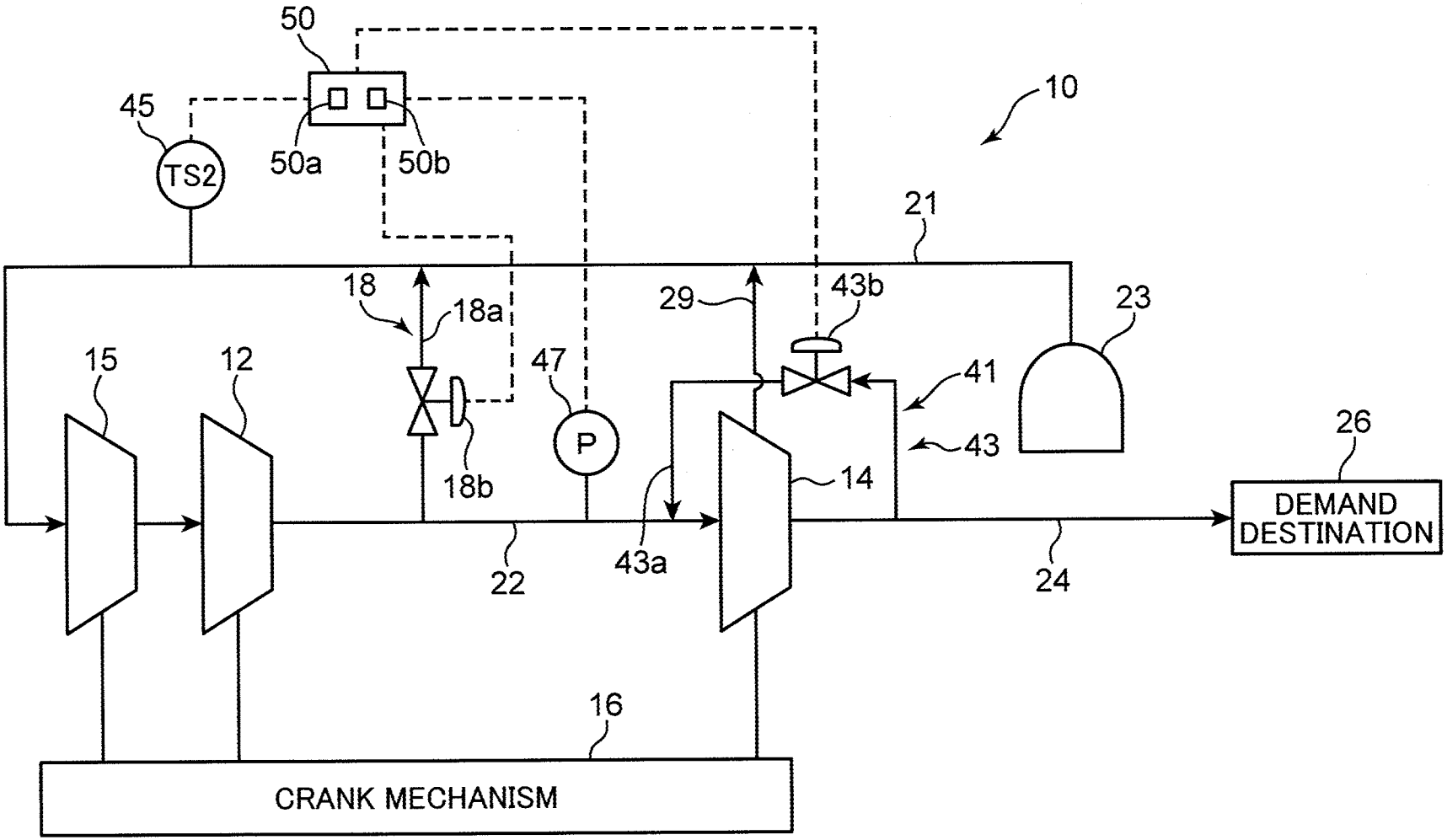
FIG. 16 is a diagram schematically illustrating the compressor unit according to another embodiment.

For example, the compressor unit 10 illustrated in FIG. 1 may further include a front compression stage 15 on the upstream side of the first compression stage 12 as illustrated in FIG. 16. In this case, the first spillback unit 18 is provided on the downstream side of a second compression stage from the front, which is the first compression stage 12. Even in the aspect illustrated in FIG. 16, deterioration of power of the compressor unit 10 can be suppressed more than when hydrogen gas is spilled back from the discharge flow path 24 in the succeeding compression stage 14 to the suction flow path 21. Note that the number of the front compression stages 15 may be two or more. The same applies to the other drawings.

Here, the above embodiments will be outlined.

(1) A compressor unit according to the embodiment is a reciprocating compressor unit configured to recover hydrogen gas that is boil-off gas from a liquid hydrogen storage tank and supply at least a part of the hydrogen gas to a demand destination including at least one of an engine, a power generation facility, and a boiler, the compressor unit including a first compression stage configured to compress hydrogen gas, one or two or more succeeding compression stage configured to further compress hydrogen gas discharged from the first compression stage, a crank mechanism configured to drive the first compression stage and the succeeding compression stage, a first spillback unit including a first spillback flow path and a first spillback valve, the first spillback flow path being for returning a part of hydrogen gas after being discharged from the first compression stage to a suction flow path, and the first spillback valve being for adjusting a spillback amount in the first spillback flow path, an adjusting means for adjusting a processing amount of hydrogen gas by the succeeding compression stage, a pressure sensor arranged on an intermediate flow path between the first compression stage and the succeeding compression stage, an upstream side temperature sensor arranged on the suction flow path between a connection portion with the first spillback flow path and the first compression stage, and a controller configured to control each of the first spillback valve and the adjusting means. Each of the first compression stage and the succeeding compression stage includes a cylinder unit, a piston, a piston rod connecting the piston to the crank mechanism, and rod packing that seals between the piston rod and the cylinder unit. The first compression stage is of an air cooling type and an oil free type. At least a part of the succeeding compression stage includes a leak gas discharge unit configured to return leak gas from the rod packing to the suction flow path. The controller is capable of executing a first control of referring to suction temperature acquired by the upstream side temperature sensor to control the first spillback valve so that the suction temperature falls within a predetermined temperature range, and a second control of controlling the adjusting means so that a processing amount of the succeeding compression stage is adjusted according to a change amount of pressure in the intermediate flow path caused by the first control. The predetermined temperature range is set to a range higher than a reference temperature based on liquefaction temperature of air and less than 0° C.

According to the compressor unit, the compressor unit can be protected in a low temperature environment. More specifically, in the first control, a flow rate of hydrogen gas returned to the suction flow path by the first spillback unit is adjusted, so that suction temperature of hydrogen gas before being suctioned into the first compression stage can be adjusted. Further, since a temperature range of hydrogen gas suctioned into the first compression stage is adjusted to be higher than the reference temperature based on liquefaction temperature of air, it is possible to avoid occurrence of liquefaction of oxygen as oxidizing gas in a suction portion of the first compression stage or a suction flow path. Further, by setting suction temperature to a predetermined temperature range to a range higher than the reference temperature based on liquefaction temperature of air and less than 0° C., it is possible to suppress decrease in processing efficiency of hydrogen gas.

Further, since the first spillback unit bypasses only the first compression stage, deterioration of power of the compressor unit can be suppressed as compared with a case where hydrogen gas is spilled back from the discharge flow path of the succeeding compression stage to the suction flow path, that is, a case where highest pressure hydrogen gas is returned to the suction flow path 21.

Further, since a processing amount of the succeeding compression stage by the adjusting means is adjusted corresponding to spillback operation by the first spillback unit, excessive compression operation in the succeeding compression stage can be suppressed. By this, power of the compressor unit can be reduced.

Further, since at least the first compression stage is of an oil free type, the risk of oil freezing can be avoided. Furthermore, pressure increases with each succeeding compression stage, and hydrogen gas easily leaks, but since hydrogen gas leaking in the succeeding compression stage is recovered to the suction flow path by the leak gas discharge unit, loss of product gas at the time of compression can be reduced.

(2) The compressor unit may include a downstream side temperature sensor arranged on the intermediate flow path, a low pressure gas discharge path that branches from a branch point on a discharge flow path further on the discharge side than the succeeding compression stage and through which hydrogen gas can be discharged to a low pressure demand destination capable of processing hydrogen gas lower than pressure of hydrogen gas required by the demand destination, a switching means provided on the low pressure gas discharge path or the branch point, and a check valve located on the downstream side of the branch point. In this case, the controller may be configured to (i) control the switching means so as to be in a first switching state in which hydrogen gas discharged from the succeeding compression stage flows through the low pressure gas discharge path in a case where detected temperature of the downstream side temperature sensor is higher than predetermined first temperature T1 that is higher than 0° C. at the time of startup, (ii) control the switching means so as to be in a second switching state in which hydrogen gas discharged from the succeeding compression stage is sent to the discharge flow path toward the demand destination in a case where detected temperature of the downstream side temperature sensor becomes less than the first temperature T1, and (iii) execute the first control and the second control on condition that the switching means is in the second switching state.

In this aspect, in a case where hydrogen gas in a piping on the liquid hydrogen storage tank side increases to a positive temperature region at the time of startup, hydrogen gas discharged from the succeeding compression stage is delivered to a low pressure demand destination. For this reason, it is possible to more effectively prevent excessive temperature increase of hydrogen gas in the succeeding compression stage. That is, in the reciprocating compressor unit, hydrogen gas at pressure corresponding to pressure set by a supply destination of hydrogen gas is delivered. For this reason, the switching means is controlled such that hydrogen gas is delivered to a low pressure demand destination, so that discharge gas pressure by the succeeding compression stage is reduced. Consequently, the succeeding compression stage can be more reliably protected. Further, startup of the compressor unit can be performed promptly. Further, the compressor unit can be protected in a low temperature environment.

(3) The compressor unit may further include a downstream side temperature sensor arranged on the intermediate flow path, a cooler provided between the first compression stage and the succeeding compression stage, and a cooler switching means capable of switching between a path through which hydrogen gas flows into the cooler and a path through which hydrogen gas flows into the succeeding compression stage without passing through the cooler. In this case, the controller may be configured to (i) control the cooler switching means so as to be in a first switching state in which hydrogen gas discharged from the first compression stage flows through the cooler and is cooled in a case where detected temperature of the downstream side temperature sensor is higher than predetermined first temperature T1 that is higher than 0° C. at the time of startup, (ii) control the cooler switching means so as to be in a second switching state in which hydrogen gas discharged from the first compression stage is sent to the succeeding compression stage without passing through the cooler in a case where detected temperature of the downstream side temperature sensor becomes less than the first temperature T1, and (iii) execute the first control and the second control on condition that the cooler switching means is in the second switching state.

In this aspect, in a case where hydrogen gas in a piping on the liquid hydrogen storage tank side increases to a positive temperature region at the time of startup, hydrogen gas discharged from the first compression stage is cooled by the cooler, so that excessive temperature increase of hydrogen gas in the succeeding compression stage can be prevented. That is, the succeeding compression stage can be protected. Further, startup of the compressor unit can be performed promptly. Further, the compressor unit can be protected in a low temperature environment.

(4) The adjusting means may include, in at least one succeeding compression stage, a second spillback unit including a second spillback flow path for returning hydrogen gas flowing on the discharge side of the succeeding compression stage to the suction side of the succeeding compression stage, and a second spillback valve for adjusting a spillback amount in the second spillback flow path, and a suction valve unloader attached to a cylinder unit of the succeeding compression stage. In this case, in the second control, the controller may control the second spillback valve according to a change amount of pressure in the intermediate flow path caused by the first control, and be configured to use, in combination, drive of the suction valve unloader when opening degree of the second spillback valve reaches a preset value, and, by this, a processing amount of the cylinder unit may be reduced and an amount to be returned to the suction side of the succeeding compression stage through the second spillback unit may be reduced.

In this aspect, power for compressing gas can be further reduced.

(5) The adjusting means may include, in at least one succeeding compression stage, a stepless capacity adjustment device having a suction valve unloader attached to a cylinder unit of the succeeding compression stage, and a hydraulic or electric drive device that opens and closes the suction valve unloader. In this case, the controller may be configured to drive the drive device so that an operation timing of the suction valve unloader is adjusted in conjunction with rotational motion of a crankshaft in the crank mechanism. Further, in the second control, the controller may control the drive device according to a change amount of pressure in the intermediate flow path caused by the first control to adjust a processing amount of the succeeding compression stage.

In this aspect, the timing of operation and operation time of the suction valve unloader are controlled, and a part of hydrogen gas in the cylinder unit is returned to the suction side, so that a gas processing amount in the succeeding compression stage can be reduced. Consequently, power can be further reduced.

As described above, the reciprocating compressor unit can be appropriately protected from boil-off gas of liquefied hydrogen at cryogenic temperature.

This application is based on Japanese Patent Application No. 2023-020152 filed on Feb. 13, 2023, the contents of which are incorporated herein by reference.

Although the present invention is appropriately and sufficiently described through the embodiments with reference to the above drawings to express the present invention, it should be recognized that a person skilled in the art can easily modify and/or improve the above-described embodiments. Therefore, unless a change or improvement made by a person skilled in the art is at a level departing from the scope of rights of the claims described in claims, the change or improvement is interpreted to be included in the scope of rights of the claims.

The invention claimed is:

1. A compressor unit that is a reciprocating compressor unit configured to recover hydrogen gas that is boil-off gas from a liquid hydrogen storage tank and supply at least a part of the hydrogen gas to a demand destination including at least one of an engine, a power generation facility, and a boiler, the compressor unit comprising:

a first compression stage configured to compress hydrogen gas;

one or two or more succeeding compression stage configured to further compress hydrogen gas discharged from the first compression stage;

a crank mechanism configured to drive the first compression stage and the succeeding compression stage;

a first spillback unit including a first spillback flow path and a first spillback valve, the first spillback flow path being for returning a part of hydrogen gas after being discharged from the first compression stage to a suction flow path, and the first spillback valve being for adjusting a spillback amount in the first spillback flow path;

an adjuster for adjusting a processing amount of hydrogen gas by the succeeding compression stage;

a pressure sensor arranged on an intermediate flow path between the first compression stage and the succeeding compression stage;

an upstream side temperature sensor arranged on the suction flow path between a connection portion with the first spillback flow path and the first compression stage; and a controller configured to control each of the first spillback valve and the adjuster, wherein each of the first compression stage and the succeeding compression stage includes:

a cylinder unit;

a piston;

a piston rod connecting the piston to the crank mechanism; and rod packing that seals between the piston rod and the cylinder unit, the first compression stage is of an air cooling type and an oil free type, at least a part of the succeeding compression stage includes a leak gas discharge unit configured to return leak gas from the rod packing to the suction flow path, the controller is configured to execute:

a first control of referring to suction temperature acquired by the upstream side temperature sensor to control the first spillback valve so that the suction temperature falls within a predetermined temperature range; and a second control of controlling the adjusting means so that a processing amount of the succeeding compression stage is adjusted according to a change amount of pressure in the intermediate flow path caused by the first control, and the predetermined temperature range is set to a range higher than a reference temperature that prevents the liquification of oxygen and less than 0° C.

2. The compressor unit according to claim 1, further comprising:

a downstream side temperature sensor arranged on the intermediate flow path;

a low pressure gas discharge path that branches from a branch point on a discharge flow path further on a discharge side than the succeeding compression stage and through which hydrogen gas can be discharged to a low pressure demand destination capable of processing hydrogen gas lower than pressure of hydrogen gas required by the demand destination;

a switcher provided on the low pressure gas discharge path or the branch point; and a check valve located on a downstream side of the branch point, wherein the controller is configured to:

control the switcher so as to be in a first switching state in which hydrogen gas discharged from the succeeding compression stage flows through the low pressure gas discharge path in a case where detected temperature of the downstream side temperature sensor is higher than predetermined first temperature T1 that is higher than 0° C. at time of startup;

control the switcher so as to be in a second switching state in which hydrogen gas discharged from the succeeding compression stage is sent to the discharge flow path toward the demand destination in a case where detected temperature of the downstream side temperature sensor becomes less than the first temperature T1; and execute the first control and the second control on condition that the switching means is in the second switching state.

3. The compressor unit according to claim 1, further comprising:

a downstream side temperature sensor arranged on the intermediate flow path;

a cooler provided between the first compression stage and the succeeding compression stage; and a cooler switcher capable of switching between a path through which hydrogen gas flows into the cooler and a path through which hydrogen gas flows into the succeeding compression stage without passing through the cooler, wherein the controller is configured to:

control the cooler switcher so as to be in a first switching state in which hydrogen gas discharged from the first compression stage flows through the cooler and is cooled in a case where detected temperature of the downstream side temperature sensor is higher than predetermined first temperature T1 that is higher than 0° C. at time of startup;

control the cooler switcher so as to be in a second switching state in which hydrogen gas discharged from the first compression stage is sent to the succeeding compression stage without passing through the cooler in a case where detected temperature of the downstream side temperature sensor becomes less than the first temperature T1; and execute the first control and the second control on condition that the cooler switcher is in the second switching state.

4. The compressor unit according to claim 1, wherein the adjuster includes, in at least one succeeding compression stage:

a second spillback unit including a second spillback flow path for returning hydrogen gas flowing on a discharge side of the succeeding compression stage to a suction side of the succeeding compression stage, and a second spillback valve for adjusting a spillback amount in the second spillback flow path; and a suction valve unloader attached to a cylinder unit of the succeeding compression stage, and in the second control, the controller controls the second spillback valve according to a change amount of pressure in the intermediate flow path caused by the first control, and is configured to use, in combination, drive of the suction valve unloader when opening degree of the second spillback valve reaches a preset value, thereby reducing a processing amount of the cylinder unit and reducing an amount to be returned to a suction side of the succeeding compression stage through the second spillback unit.

5. The compressor unit according to claim 1, wherein the adjuster includes, in at least one succeeding compression stage, a stepless capacity adjustment device having:

a suction valve unloader attached to a cylinder unit of the succeeding compression stage; and a hydraulic or electric drive device that opens and closes the suction valve unloader, the controller is configured to drive the drive device so that an operation timing of the suction valve unloader is adjusted in conjunction with rotational motion of a crankshaft in the crank mechanism, and in the second control, the controller controls the drive device according to a change amount of pressure in the intermediate flow path caused by the first control to adjust a processing amount of the succeeding compression stage.

* * * * *